US010175633B2

(12) United States Patent
Hamakawa

(10) Patent No.: US 10,175,633 B2
(45) Date of Patent: Jan. 8, 2019

(54) IMAGE FORMING APPARATUS

(71) Applicant: KYOCERA Document Solutions Inc., Osaka-shi, Osaka (JP)

(72) Inventor: Hiroyuki Hamakawa, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/842,741

(22) Filed: Dec. 14, 2017

(65) Prior Publication Data

US 2018/0181052 A1 Jun. 28, 2018

(30) Foreign Application Priority Data

Dec. 26, 2016 (JP) ..... 2016-251431

(51) Int. Cl.
*G03G 15/08* (2006.01)
*G03G 21/00* (2006.01)
(Continued)

(52) U.S. Cl.
CPC ..... *G03G 21/0064* (2013.01); *G03G 15/0808* (2013.01); *G03G 15/0812* (2013.01);
(Continued)

(58) Field of Classification Search
CPC ..... G03G 21/0064; G03G 21/10; G03G 15/0808; G03G 15/0812; G03G 15/0921
See application file for complete search history.

(56) References Cited

U.S. PATENT DOCUMENTS 6,002,900 A * 12/1999 Ishiyama ..... G03G 9/0819 399/149
6,219,509 B1 * 4/2001 Komiya ..... G03G 15/0216 399/168
(Continued)

FOREIGN PATENT DOCUMENTS

JP 2014021311 A 2/2014

OTHER PUBLICATIONS

Machine translation of Abstract & figures of reference Kimura et al. (JP 01-259,386 A); Pub Date Oct. 17, 1989 (Year: 1989).*

*Primary Examiner* — Rodney A Bonnette
(74) *Attorney, Agent, or Firm* — Alleman Hall Creasman & Tuttle LLP

(57) ABSTRACT

An image forming apparatus includes a developer storage portion, a developing roller, a magnetic force generating portion, and an image carrying member. The magnetic force generating portion is provided in the developing roller and generates a magnetic force for keeping the developer on an outer circumferential surface of the developing roller. The image carrying member is disposed to face the developing roller across a predetermined developing gap, is rotationally driven, receives the toner from the developer supplied to the developing gap by the developing roller, and keeps a toner image on an outer circumferential surface of the image carrying member. The image forming apparatus, during non image formation, supplies a more amount of developer to the developing gap than an amount of developer for developing supplied to the developing gap during image formation such that the outer circumferential surface of the image carrying member is cleaned.

14 Claims, 19 Drawing Sheets

(51) Int. Cl.
*G03G 21/10* (2006.01)
*G03G 15/09* (2006.01)

(52) U.S. Cl.
CPC ..... *G03G 15/0921* (2013.01); *G03G 21/0011* (2013.01); *G03G 21/10* (2013.01)

(56) References Cited

U.S. PATENT DOCUMENTS

| | | | | |
|---|---|---|---|---|
| 10,082,764 | B2 * | 9/2018 | Yamane | G03G 15/0921 |
| 2006/0045571 | A1 * | 3/2006 | Matsuura | G03G 21/0064 399/149 |

* cited by examiner

IMAGE FORMING APPARATUS

INCORPORATION BY REFERENCE

This application is based upon and claims the benefit of priority from the corresponding Japanese Patent Application No. 2016-251431 filed on Dec. 26, 2016, the entire contents of which are incorporated herein by reference.

BACKGROUND

The present disclosure relates to an image forming apparatus including an image carrying member such as a photoconductor drum, and, in particular, relates to a cleaning mechanism for cleaning a surface of the image carrying member with developer.

In an image forming apparatus such as a copier or a printer that forms an image on a paper sheet by an electrophotographic system, a developing device is installed. The developing device develops, with toner, an electrostatic latent image that has been formed on a photoconductor drum (image carrying member). The developing device includes a developing roller that is disposed separate from the photoconductor drum by a predetermined gap. One of known developing systems is a developing system in which developer is magnetically drawn up from a developer storage chamber to the surface of the developing roller, and toner is supplied from the developing roller to the electrostatic latent image on the photoconductor drum by an electric field generated by a developing bias applied to the developing roller such that the electrostatic latent image is developed with the toner.

This type of image forming apparatus includes a cleaning device that cleans the surface of the photoconductor drum by removing, by a blade member, deposits such as residual toner and discharge products that have adhered to the surface of the photoconductor drum. In addition, there is known an image forming apparatus that includes, in addition to the cleaning device, a magnetic brush forming portion that is configured to remove discharge products that have adhered to the photoconductor drum.

SUMMARY

An image forming apparatus according to an aspect of the present disclosure includes a developer storage portion, a developing roller, a magnetic force generating portion, and an image carrying member. The developer storage portion stores developer that includes toner and carrier. The developing roller is provided in an inside of the developer storage portion and is rotationally driven. The magnetic force generating portion is provided in an inside of the developing roller and generates a magnetic force for keeping the developer on an outer circumferential surface of the developing roller. The image carrying member is disposed to face the developing roller across a predetermined developing gap, is rotationally driven, receives the toner from the developer supplied to the developing gap by the developing roller, and keeps a toner image on an outer circumferential surface of the image carrying member. The image forming apparatus, during non image formation, supplies a more amount of developer to the developing gap than an amount of developer for developing supplied to the developing gap during image formation such that the outer circumferential surface of the image carrying member is cleaned.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and can be modified as necessary in a range where the gist of the present disclosure is not changed.

First Embodiment

Figure 1:
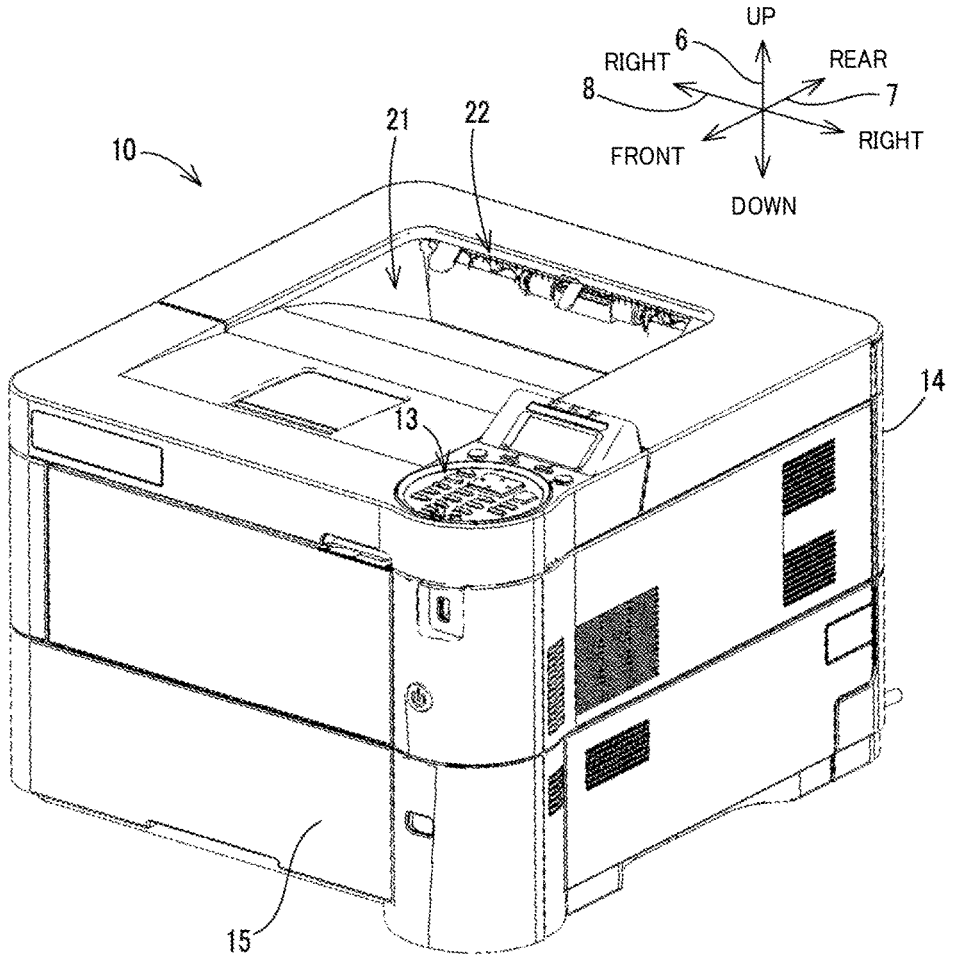
FIG. 1 is a perspective diagram showing an external appearance configuration of an image forming apparatus according to a first embodiment of the present disclosure.
Figure 2:
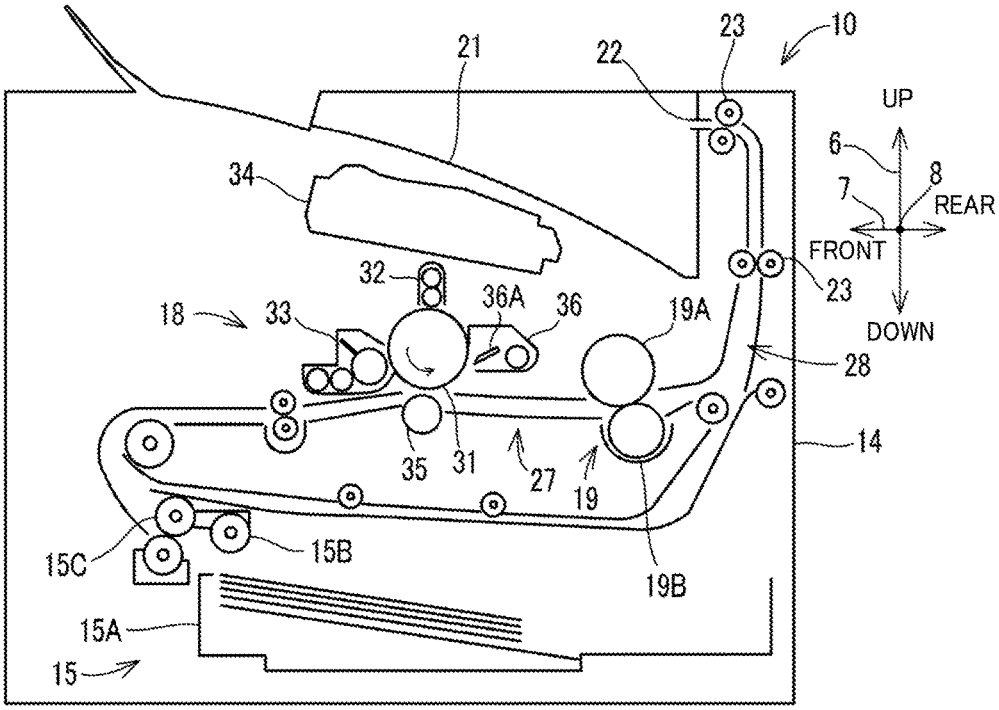
FIG. 2 is a cross-sectional diagram showing an internal configuration of the image forming apparatus according to the first embodiment of the present disclosure.

In the following, a first embodiment of the present disclosure is described. FIG. 1 and FIG. 2 describe a configuration of an image forming apparatus 10 according to the present embodiment. FIG. 1 is a perspective diagram of the image forming apparatus 10. FIG. 2 is a cross-sectional diagram of the image forming apparatus 10. The image forming apparatus 10 is an example of the image forming apparatus of the present disclosure. It is noted that for the sake of explanation, an up-down direction 6 is defined based on the state where the image forming apparatus 10 is installed in a usable manner (the state shown in FIG. 1). In addition, a front-rear direction 7 is defined on the supposition that the front side (front) of FIG. 1 is the front, and a left-right direction 8 is defined on the basis of the image forming apparatus 10 viewed from the front side (front).

[Configuration of Image Forming Apparatus 10]

As shown in FIG. 1, the image forming apparatus 10 is a multifunction peripheral having a plurality of functions such as a printer function and a facsimile function. The image forming apparatus 10 prints an input image on a print sheet by using a print material such as toner. It is noted that the image forming apparatus 10 is not limited to a multifunction peripheral, but the present disclosure is applicable to a dedicated apparatus such as a printer, a facsimile, or a copier.

The image forming apparatus 10 is configured to print an image on a print sheet based on image data that is input from outside via a network communication portion (not shown). As shown in FIG. 2, the image forming apparatus 10 includes an operation panel 13, an electrophotographic image forming portion 18, a fixing device 19, a sheet feed device 15, a sheet discharge portion 21, a humidity sensor 40, and a control portion 90 for comprehensively controlling the image forming apparatus 10 (see FIG. 5). These components are disposed in a housing 14 (apparatus main body) that constitutes a cover of an external frame, an internal frame and the like of the image forming apparatus 10.

As shown in FIG. 2, the sheet feed portion 15 is provided in a lowest part of the image forming apparatus 10. The sheet feed device 15 includes a sheet feed tray 15A, a pickup roller 15B, and a sheet feed roller 15C. The sheet feed tray 15A stores, in a stack, print sheets on which images are to be formed by the image forming portion 18. When an instruction to start feeding a print sheet is input to the image forming apparatus 10, the pickup roller 15B is rotationally driven by a conveyance motor (not shown), and a print sheet is fed from the sheet feed tray 15A. The print sheet fed by the pickup roller 15B is conveyed by the sheet feed roller 15C toward the downstream side in the feeding direction.

The image forming portion 18 forms an image on a print sheet of a prescribed size, based on image data input from outside. The image forming portion 18 transfers a toner image to the print sheet by using a print material such as toner. Specifically, as shown in FIG. 2, the image forming portion 18 includes a photoconductor drum 31 (an example of the image carrying member of the present disclosure), a charging device 32, a developing device 33, a transfer device 35, a cleaning device 36, and an exposure device 34.

The photoconductor drum 31 is disposed to face a developing roller 63 that is described below, across a developing gap 68 of a predetermined interval (see FIG. 3), and is configured to carry, on its outer circumferential surface, a toner image formed from the toner supplied across the developing gap 68 from the developing roller 63. The photoconductor drum 31 is rotationally supported by, for example, an internal frame of the image forming apparatus 10. A photosensitive layer is formed on the outer circumferential surface of the photoconductor drum 31. In the present embodiment, the photoconductor drum 31 has a cylindrical shape and has a diameter of 30.0 mm. A rotational driving force from a motor is transmitted to the photoconductor drum 31. When the motor is drive-controlled by the control portion 90 that is described below, the rotational driving force is transmitted to the photoconductor drum 31, and the photoconductor drum 31 is rotationally driven to rotate in a predetermined direction (namely, a rotation direction opposite to the rotation direction of the developing roller 63).

In the present embodiment, the photoconductor drum 31 is rotationally driven so as to rotate at a linear speed of 200 mm/s during an image formation process (during an image formation operation).

The charging device 32 is disposed vertically above the photoconductor drum 31. The charging device 32 applies an even and uniform potential to the outer circumferential surface of the photoconductor drum 31 by a corona discharge or the like. In addition, the exposure device 34 is disposed at an upper part of the image forming portion 18, above the developing device 33, the charging device 32, and the cleaning device 36.

When an image formation operation is started, the charging device 32 uniformly charges the surface of the photoconductor drum 31 to a certain potential. In addition, the exposure device 34 scans a laser beam on the photoconductor drum 31 based on image data. In this processing, an electrostatic latent image is formed on the photoconductor drum 31. Subsequently, the developing device 33 develops a toner image on the photoconductor drum 31 by adhering the toner to the electrostatic latent image. The toner image is transferred by the transfer device 35, to a print sheet fed from the sheet feed tray 15A. The print sheet with the toner image transferred thereto is fed to a conveyance path 27 extending from the image forming portion 18 to the fixing device 19, and is conveyed to the fixing device 19 that is disposed more on the downstream side in the conveyance direction (namely, more on the rear side) than the image forming portion 18.

The fixing device 19 is configured to fix the toner image that has been transferred to the print sheet, to the print sheet by heat, and includes a heating roller 19A and a pressure roller 19B. The heating roller 19A is heated by a heating device, such as an IH heater, during a fixing operation. When the print sheet passes through the fixing portion 19, the toner is heated and fused by the fixing device 19. This allows the toner image to be fixed to the print sheet, thereby an image is formed on the print sheet. At this time, the print sheet is heated to a high temperature. The print sheet after the fixing passes along a conveyance path 28 to be conveyed upward, and is discharged from a sheet discharge port 22 to the sheet discharge portion 21 that is provided on an upper surface of the image forming apparatus 10.

As shown in FIG. 1, the cleaning device 36 has a cleaning blade 36A that removes, by scraping off, deposits such as residual toner and discharge products that have adhered to the surface of the photoconductor drum 31. The cleaning blade 36A is a plate-like resin-made member, and the tip thereof is in contact with the surface of the photoconductor drum 31. When the photoconductor drum 31 rotates and comes into contact with the cleaning blade 36A, the deposits are removed. The removed deposits are collected in a collection bottle or the like by a conveyance screw included in the cleaning device 36.

The housing 14 has, in its inside, devices that generate heat when they are driven, such as the fixing device 19, the exposure device 34, and motors. As a result, the internal temperature of the housing 14 changes as the fixing device 19, the exposure device 34, and the like generate heat. On the other hand, the humidity in the external environment of the housing 14, namely the humidity in the installation environment of the image forming apparatus 10 is not influenced and varied by the operation of the image forming apparatus 10. In the present embodiment, a cleaning process that is described below is executed depending on the external environment of the housing 14 (installation environment of the image forming apparatus 10). Specifically, the cleaning process is executed depending on the state of humidity outside the housing 14. For this purpose, the image forming apparatus 10 includes the humidity sensor 40. The humidity sensor 40 is a sensor of a polymer resistance type, a polymer capacitive type, an aluminum oxide capacitive type, or the like that is configured to detect the humidity in air, and is a unit type sensor in which humidity sensor elements and a calculation portion and the like are integrally formed. The humidity sensor 40 outputs electric signals of analog voltage or analog current representing the detected humidity. In the present embodiment, the probe of the humidity sensor 40 is exposed to outside of the image forming apparatus 10, and detects the volume absolute humidity outside the apparatus, namely, detects the volume absolute humidity in the installment environment of the image forming apparatus 10. Here, the volume absolute humidity is the density of the vapor included in air (mass per volume), and as the unit, gram per cubic meter ($g/m^3$) is used. Hereinafter, the volume absolute humidity is merely referred to as absolute humidity. The control portion 90 that is described below is configured to determine the absolute humidity outside the image forming apparatus 10 based on the electric signal from the humidity sensor 40.

[Configuration of Developing Device 33]

Figure 3:
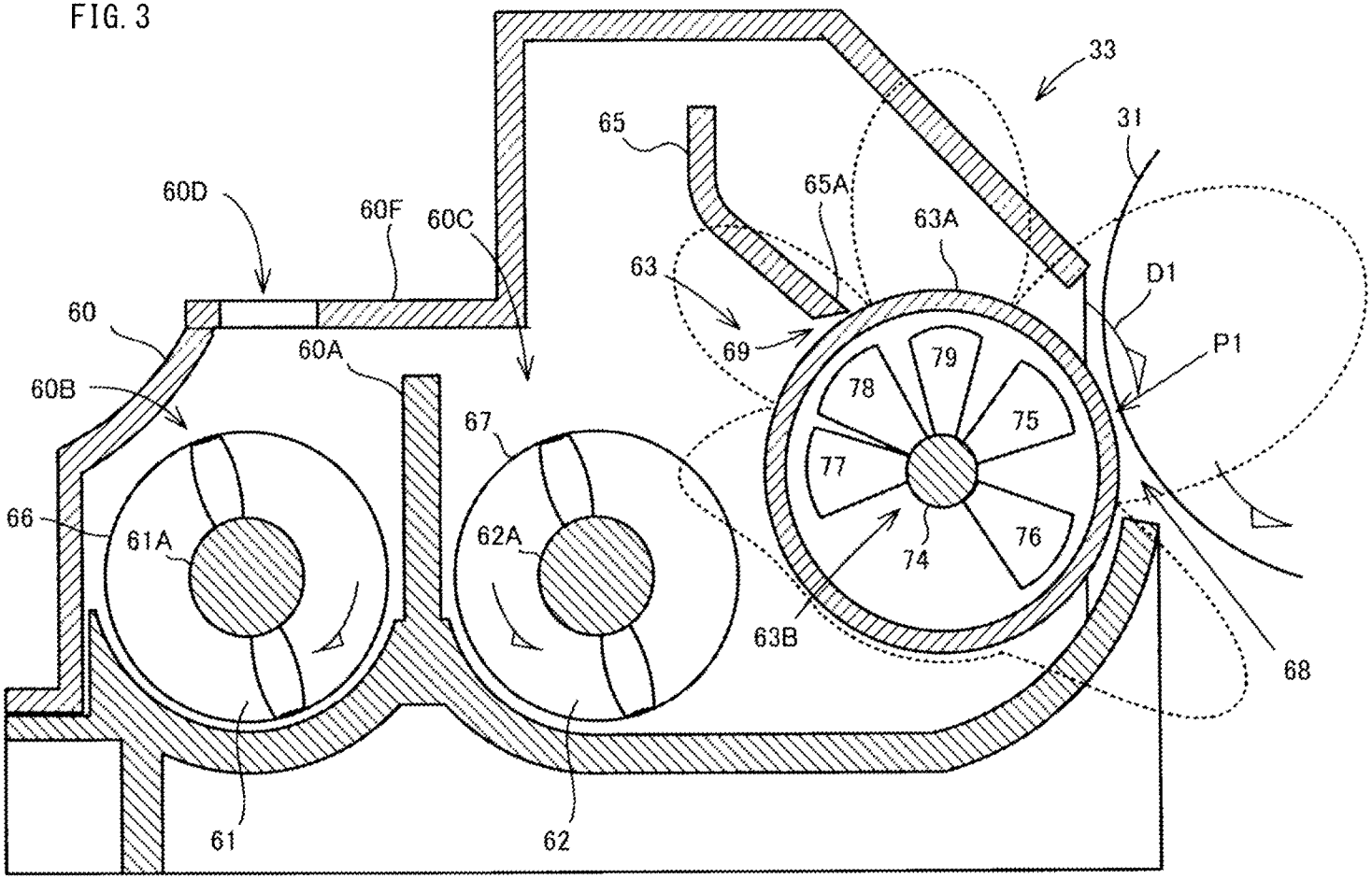
FIG. 3 is a cross-sectional diagram showing a configuration of a developing device included in the image forming apparatus according to the first embodiment of the present disclosure.

FIG. 3 is a cross-sectional diagram showing the configuration of the developing device 33 included in the image forming portion 18. The developing device 33 develops the electrostatic latent image with toner by a developing system in which the toner is electrostatically adhered to the electrostatic latent image by causing a so-called magnetic brush to be in contact with the photoconductor drum 31. As the developer used in the developing, a two-component developer whose main components are non-magnetic toner and magnetic carrier, is used. In the present embodiment, as one example, the developing device 33 performs the developing by using the two-component developer whose main components are the non-magnetic toner and the magnetic carrier.

As shown in FIG. 3, the developing device 33 includes a developer holder 60 (an example of the developer storage portion of the present disclosure), a first stirring screw 61, a second stirring screw 62, a developing roller 63, and a regulation blade 65 (an example of the blade member of the present disclosure).

The developer holder 60 stores the two-component developer (hereinafter, also referred to as merely "developer") that contains the non-magnetic toner. The developer used in the present embodiment includes external additives such as titanium oxide and silica, as well as the toner and the carrier. The developer holder 60 stores the developer and plays a role of a housing of the developing device 33. The developer holder 60 is formed to be elongated in the longitudinal direction (a direction vertical to the plane of FIG. 3) of the developing device 33. The developer holder 60 is divided by a partition wall 60A into a first storage chamber 60B and a second storage chamber 60C. The developer is stored in each of the first storage chamber 60B and the second storage chamber 60C. It is noted that the first storage chamber 60B and the second storage chamber 60C are not completely separate from each other, but are communicated with each other by a communication passage (not shown) that is provided to extend in the longitudinal direction of the developing device 33.

The first stirring screw 61 is rotationally provided in the first storage chamber 60B with a blade member 66 of a spiral shape around its axis. The second stirring screw 62 is rotationally provided in the second storage chamber 60C with a blade member 67 of a spiral shape around its axis. The first stirring screw 61 and the second stirring screw 62 are rotationally supported by side walls of the developer holder 60 that are opposite to each other in the longitudinal direction.

A rotational driving force is transmitted from a first motor 37 (see FIG. 5) to a rotation shaft 61A of the first stirring screw 61 and a rotation shaft 62A of the second stirring screw 62. The first motor 37 is a driving source such as a stepping motor that outputs the rotational driving force. The first motor 37 is coupled with the first stirring screw 61 and the second stirring screw 62 via a transmission mechanism such as a gear. With this configuration, the first stirring screw 61 and the second stirring screw 62 are rotated in a predetermined direction, and the developer stored therein is stirred. When the developer is stirred by the first stirring screw 61 and the second stirring screw 62, an electric charge is applied to the toner. In the present embodiment, the developer is cyclically conveyed in one direction in the first storage chamber 60B and the second storage chamber 60C by passing through the communication passage formed in the partition wall 60A.

The developer holder 60 has a supply port 60D. The supply port 60D is formed in a top wall 6OF that constitutes a flat wall surface at the top of the first storage chamber 60B. The supply port 60D is a through hole that guides, to the developer holder 60, the toner supplied from a toner container (not shown) provided in the housing 14.

As shown in FIG. 3, the developing roller 63 is rotationally provided in the developer holder 60. Specifically, the developing roller 63 is provided on the right side of the second stirring screw 62 (on the photoconductor drum 31 side) in the second storage chamber 60C. In detail, the developing roller 63 is provided in parallel to the first stirring screw 61, the second stirring screw 62, and the photoconductor drum 31. The developing roller 63 is disposed to face the photoconductor drum 31 across the developing gap 68 of a predetermined interval.

The developing roller 63 is a roller member that is rotationally driven while keeping the toner which is contained in the developer, on its outer circumferential surface.

The developing roller 63 includes a cylindrical developing sleeve 63A. In the present embodiment, a sleeve whose diameter is 16.0 mm is used as the developing sleeve 63A. That is, the diameter of the developing sleeve 63A is 16.0 mm. The developing sleeve 63A is rotationally supported in the second storage chamber 60C. The developing sleeve 63A is constituted from a tube made of aluminum.

The developing roller 63 is disposed to face the photoconductor drum 31. The developing roller 63 is disposed to face the outer circumferential surface of the photoconductor drum 31 across the developing gap 68 (see FIG. 3). In the present embodiment, the minimum interval between the developing roller 63 and the photoconductor drum 31 in the developing gap 68 is 0.36 mm.

Upon receiving a rotational driving force from a second motor 38 (see FIG. 5), the developing sleeve 63A of the developing roller 63 rotates in a rotation direction D1 (clockwise in FIG. 3) indicated by an arrow in FIG. 3. The developing sleeve 63A is rotated in a rotation direction that is opposite to the rotation direction of the second stirring screw 62. The second motor 38 is a driving source such as a stepping motor that outputs the rotational driving force. The second motor 38 is coupled with the rotation shaft of the developing sleeve 63A of the developing roller 63 via a transmission mechanism such as a gear. With this configuration, the second motor 38 transmits the rotational driving force to the developing sleeve 63A so as to rotationally drive the developing sleeve 63A. It is noted that in the present embodiment, although the first stirring screw 61, the second stirring screw 62, and the developing sleeve 63A are respectively rotationally driven by separate motors, they may be rotationally driven by one motor in conjunction with each other, for example.

It is noted that in the image formation process, the developing sleeve 63A is rotationally driven so as to rotate at a linear speed of 300 mm/s. In this case, in the image formation process, the difference in circumferential speed (relative speed difference) between the developing sleeve 63A and the photoconductor drum 31 is 100 mm/s, and the circumferential speed ratio of the developing sleeve 63A to the photoconductor drum 31 is 1.5 (1.5 times).

The developing roller 63 includes a magnet unit 63B (an example of the magnetic force generating portion of the present disclosure) that includes a plurality of magnetic poles. The magnet unit 63B is provided in an inside of the developing sleeve 63A. The magnet unit 63B is fixed to, for example, an internal frame of the housing 14. As a result, the magnet unit 63B does not rotate in conjunction with the rotation of the developing sleeve 63A. In the present embodiment, the magnet unit 63B includes five magnetic poles: a main pole 75 (an example of the developing magnetic pole of the present disclosure); a peeling pole 76; a draw-up pole 77; a regulation pole 78 (an example of the regulation magnetic pole of the present disclosure); and a carrying pole 79. The magnetic poles 75 to 79 are each constituted from a permanent magnet that generates a magnetic force. In FIG. 3, a magnetic flux density distribution of magnetic fields formed by the magnetic poles 75 to 79 is indicated by a dotted line. The magnetic flux density distribution is a magnetic flux density distribution of magnetic field components in a direction vertical to the outer circumferential surface of the developing sleeve 63A.

The main pole 75 generates a peak magnetic force in the developing gap 68 that includes a facing position P1 (the position of the minimum interval) at which the developing roller 63 faces the photoconductor drum 31, and generates a magnetic field in the developing gap 68 by the peak magnetic force. The main pole 75 is attached to the magnet unit 63B in a state where the magnetic pole face thereof is oriented toward the photoconductor drum 31. It is noted that the facing position P1 is, in the developing gap 68, on a straight line L1 that connects the center of the developing roller 63 and the center of the photoconductor drum 31.

The peeling pole 76 has an opposite polarity to the main pole 75, and forms a peeling region that has substantially zero magnetic flux density on an opposite side to the photoconductor drum 31 on the developing sleeve 63A. When the developer is carried to the peeling region, the force that magnetically attracts the developer is lost, and the developer is peeled off from the peeling region. The peeled developer is returned to the second storage chamber 60C, and is conveyed again while stirred by the second stirring screw 62. After stirred and conveyed by the second stirring screw 62, the developer is drawn up onto the developing sleeve 63A again by the draw-up pole 77 as appropriately charged developer.

The draw-up pole 77 has an opposite polarity to the main pole 75, has the same polarity as the peeling pole 76, and causes the developer to be attracted and adsorbed on the surface of the developing sleeve 63A by a magnetic force. The draw-up pole 77 causes the developer to be carried on the surface of the developing sleeve 63A. The developing sleeve 63A is rotated in this state, and thereby the developer is carried to the facing position P1 that faces the photoconductor drum 31.

A regulation blade 65 is provided in the developer holder 60. The regulation blade 65 is constituted from a magnetic substance, and is, for example, a plate-like member made of a metal having magnetism. The regulation blade 65 is formed to extend in the longitudinal direction (a direction vertical to the plane of FIG. 3) of the developer holder 60. The regulation blade 65 is disposed on the upstream side of the facing position P1 in the rotation direction D1 of the developing roller 63 (clockwise in FIG. 3). The regulation blade 65 forms a regulation gap 69, which is a slight gap, between itself and the outer circumferential surface of the developing roller 63. That is, the regulation gap 69 is formed between a tip portion 65A of the regulation blade 65 and the outer circumferential surface of the developing sleeve 63A. When the developing sleeve 63A is rotationally driven in the rotation direction D1, the developer that had adhered to the developing roller 63 is conveyed toward the downstream side in the rotation direction D1 and is regulated by the regulation blade 65 so that a regulated amount of developer is conveyed to the downstream side of the regulation blade 65 in the rotation direction D1. That is, when the developer that had adhered to the developing roller 63 passes under the regulation blade 65, the developer is regulated by the regulation blade 65 so as to have a predetermined thickness corresponding to the regulation gap 69. This unifies the amount of developer conveyed toward the downstream side in the rotation direction D1 from the regulation blade 65. On the other hand, on the upstream side of the regulation blade 65 in the rotation direction D1, the developer regulated by the regulation blade 65 stagnates.

The regulation pole 78 has the same polarity as the main pole 75, and generates a peak magnetic force at a position on the developing sleeve 63A that is located on the upstream side of the regulation gap 69 of the regulation blade 65 in the rotation direction D1 and is separate therefrom by a predetermined angle. The regulation pole 78 carries the developer in the rotation direction D1 toward the downstream while keeping it on the developing sleeve 63A so that the developer passes through the regulation gap 69 between the regulation blade 65 and the developing sleeve 63A. As described above, since the regulation blade 65 is constituted from a magnetic substance, a polarity opposite to that of the regulation pole 78 is induced to the tip portion 65A of the regulation blade 65 by the regulation pole 78. This allows a magnetic field to be generated between the regulation pole 78 and the tip portion 65A of the regulation blade 65, wherein the magnetic field is in a direction in which the developer is attracted to the tip portion 65A of the regulation blade 65. This magnetic field allows a magnetic brush composed of bristles formed from the developer, to be formed between the regulation blade 65 and the developing sleeve 63A. When the magnetic brush passes through the regulation gap 69, the magnetic brush is regulated to a predetermined height, and the height of the developer is regulated uniformly.

The carrying pole 79 has an opposite polarity to the main pole 75, and keeps and carries, in the circumferential direction, the developer on the developing sleeve 63A before developing.

When the developer whose thickness has been made uniform by the regulation pole 78 and the regulation blade 65 reaches the developing gap 68, the magnetic brush is formed by a magnetic field generated by the main pole 75, and the magnetic brush comes into contact with the surface of the photoconductor drum 31, thereby the electrostatic latent image on the photoconductor drum 31 is developed with the toner.

Figure 4:
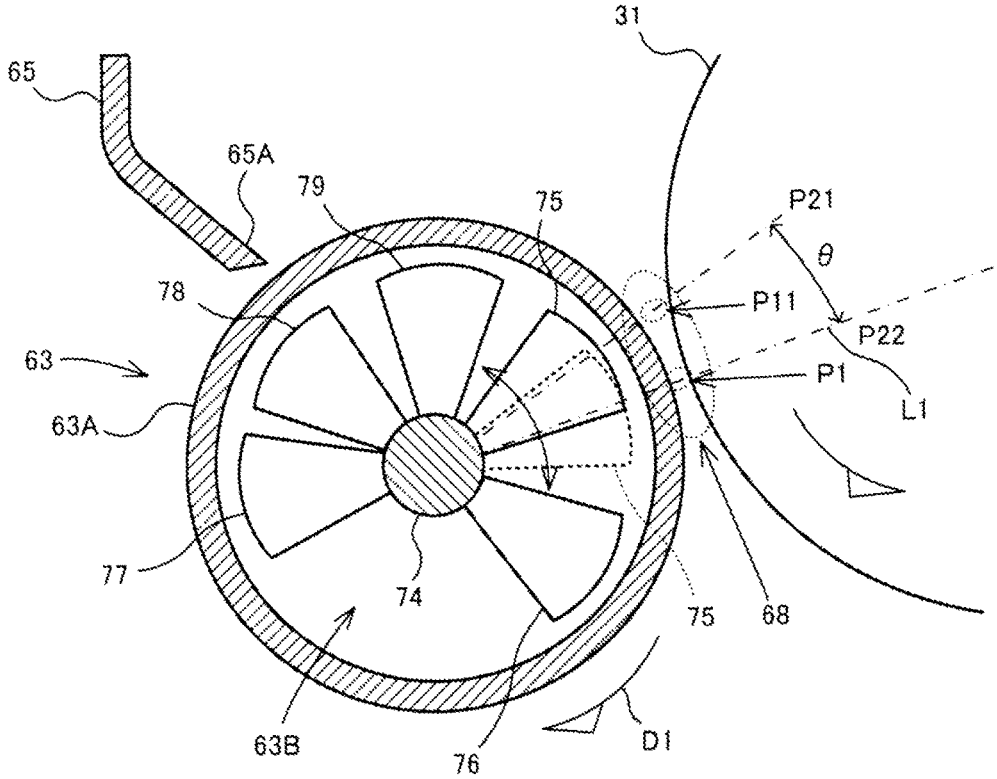
FIG. 4 is an enlargement diagram of a developing roller included in the image forming apparatus according to the first embodiment of the present disclosure.

In the present embodiment, the main pole 75 is configured to be pivoted (displaced) around an axis of the magnet unit 63B. The main pole 75 is supported by a movable bracket (not shown). The movable bracket is pivotably supported by a support shaft 74 located at the center of the magnet unit 63B. With this configuration, the main pole 75 can pivot around the axis of the support shaft 74 of the magnet unit 63B. As shown in FIG. 4, in the inside of the developing sleeve 63A, the main pole 75 is supported by the magnet unit 63B so as to pivot between a first magnetic pole position P21 and a second magnetic pole position P22.

At both of the first magnetic pole position P21 and the second magnetic pole position P22, the main pole 75 can generate a magnetic field in the developing gap 68. In FIG. 4, the main pole 75 represented by a solid line is located at the first magnetic pole position P21. When the main pole 75 is located at the first magnetic pole position P21, a peak magnetic force is applied to a predetermined first position P11 (an example of the first position of the present disclosure) in the developing gap 68, and a magnetic field is generated in the developing gap 68. The first position P11 is located on the upstream side of the facing position P1 in the rotation direction D1, and separate from the facing position P1 by angle θ. In FIG. 4, the main pole 75 represented by a dotted line is located at the second magnetic pole position P22. When the main pole 75 is located at the second magnetic pole position P22, a peak magnetic force is applied to the facing position P1 (an example of the second position of the present disclosure) in the developing gap 68, and a magnetic field is generated in the developing gap 68, wherein the facing position P1 is located on the downstream side of the first position P11 in the rotation direction D1 in the developing gap 68. It is noted that in the present embodiment, the facing position P1 is determined, as one example, as the second position of the present disclosure. However, the second position of the present disclosure is not limited to the facing position P1, but may be a position located between the first position P11 and the facing position P1 and closer to the facing position P1 than to the first position P11.

A third motor 39 (see FIG. 5) transmits a rotational driving force to the movable bracket of the main pole 75. The third motor 39 is a driving source such as a stepping motor that outputs the rotational driving force. The third motor 39 is coupled with the movable bracket via a transmission mechanism such as a gear. With this configuration, the main pole 75 together with the movable bracket can be displaced between the first magnetic pole position P21 and the second magnetic pole position P22. In the present embodiment, when a developer amount increasing process is executed in a cleaning process described below, the main pole 75 is disposed at either the first magnetic pole position P21 or the second magnetic pole position P22.

In the present embodiment, when the image formation process is executed, the main pole 75 is disposed at the first magnetic pole position P21. In addition, when the cleaning process is executed, the main pole 75 is moved from the first magnetic pole position P21 to the second magnetic pole position P22. Here, the second magnetic pole position P22 is closer to the photoconductor drum 31 than the first magnetic pole position P21. Accordingly, the magnetic field generated at the facing position P1 when the main pole 75 is disposed at the second magnetic pole position P22, is higher in strength than the magnetic field generated at the facing position P1 when the main pole 75 is disposed at the first magnetic pole position P21. As a result, in the state where the main pole 75 is disposed at the second magnetic pole position P22, more developer is collected at the facing position P1 than in a case where the main pole 75 is disposed at the first magnetic pole position P21, due to a difference in strength of the magnetic field.

[Configuration of Control Portion 90]

Figure 5:
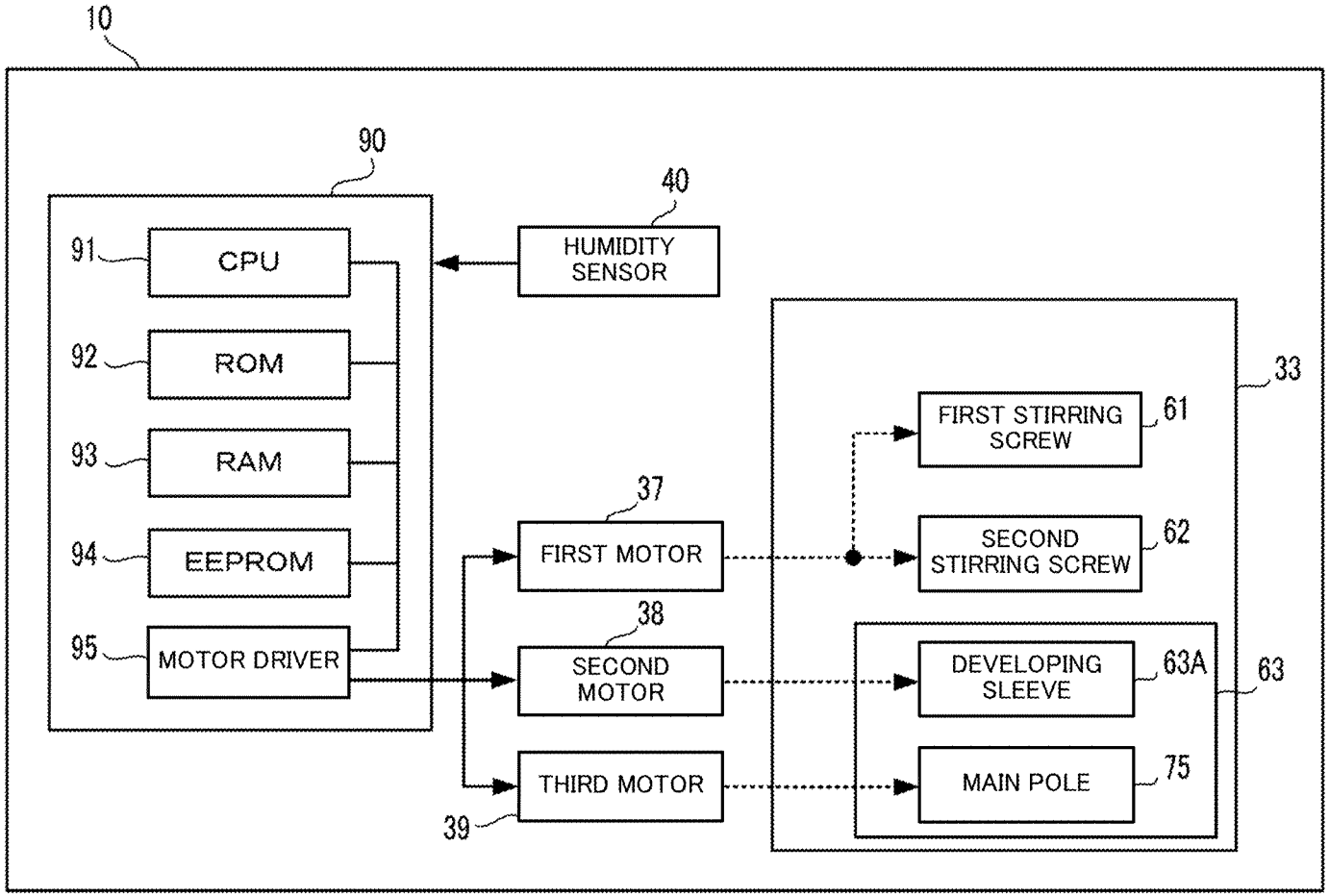
FIG. 5 is a block diagram showing a configuration of a control portion included in the image forming apparatus according to the first embodiment of the present disclosure.

Next, a description is given of the control portion 90 with reference to FIG. 5. The control portion 90 comprehensively controls the image forming apparatus 10. As shown in FIG. 5, the control portion 90 includes a CPU 91, a ROM 92, a RAM 93, an EEPROM™ 94, and a motor driver 95. The ROM 92 is a nonvolatile storage device, the RAM 93 is a volatile storage device, and the EEPROM 94 is a nonvolatile storage device. The RAM 93 and the EEPROM 94 are used as temporary storage memories by various processes executed by the CPU 91. The motor driver 95 drive-controls the first motor 37, the second motor 38, and the third motor 39 individually and independent of each other, based on a control signal from the CPU 91. In addition, the EEPROM 94 stores various types of information, set values, thresholds and the like that are used in the cleaning process described below. In addition, a predetermined control program is stored in the ROM 92. It is noted that the control portion 90 may be constituted from an electronic circuit such as an integrated circuit (ASIC, DSP).

The control portion 90 comprehensively controls the image forming apparatus 10 by causing the CPU 91 to execute the predetermined control program stored in the ROM 92. Specifically, a program (image formation processing program) for realizing an image formation is stored in the ROM 92. Furthermore, the ROM 92 stores a control program for executing the cleaning process including the developer amount increasing process in which when a condition for increasing the amount of developer at the facing position P1 is satisfied, the main pole 75 is moved from the first magnetic pole position P21 to the second magnetic pole position P22. It is noted that the control portion 90 for executing the cleaning process is an example of the magnetic pole position control portion of the present disclosure.

The image forming apparatus 10 includes the first motor 37, the second motor 38, the third motor 39, the cooling fan 29, and the humidity sensor 40. The control portion 90 is electrically connected with the first motor 37, the second motor 38, the third motor 39, the cooling fan 29, and the humidity sensor 40 via an internal bus, a signal line and the like. The first motor 37, the second motor 38, and the third motor 39 are individually drive-controlled by the motor driver 95. In addition, the humidity sensor 40 is configured to detect the absolute humidity outside the housing 14, and send a signal indicating the detected humidity to the control portion 90. The control portion 90 determines the absolute humidity outside the housing 14 based on the signal sent from the humidity sensor 40.

In the image forming apparatus 10 configured as described above, the cleaning device 36 causes the cleaning blade 36A to come into contact with the surface of the photoconductor drum 31 so as to remove deposits such as residual toner, external additives such as titanium oxide and silica, and discharge products. As a result, in a case where the residual toner has decreased due to continuous developing at a low printing rate, or in a case where discharge products such as nitrogen oxides (NOx) have increased during charging such as the corona discharge by the charging device 32, the load of the cleaning blade 36A by the contact friction increases. In this case, the tip of the cleaning blade 36A is deteriorated due to wear and chipping. When the deposits such as the residual toner fail to be removed by deteriorated cleaning blade 36A and used in the developing again, a problem of a low-quality image occurs. It may be possible to provide a known magnetic brush forming portion that can remove the deposits. In that case, however, it is necessary to secure an installation space in the periphery of the image forming portion 18 so that an entity other than the cleaning device 36 can be installed. This disturbs miniaturization of the image forming portion 18. In addition, the magnetic brush forming portion causes the magnetic brush composed of the developer to come into contact with the surface of the photoconductor drum 31. As a result, when the developer is made contact twice in the image formation step, the external additives are apt to remain on the surface of the photoconductor drum 31. Due to the external additives that have remained on the surface of the photoconductor drum 31, the color development of the toner may be reduced, thereby the image quality may be reduced. On the other hand, the image forming apparatus 10 of the present embodiment is configured to effectively remove the deposits such as residual toner, external additives, and discharge products that have adhered to the surface of the image carrying member such as the photoconductor drum 31.

[Cleaning Process]

Figure 6:
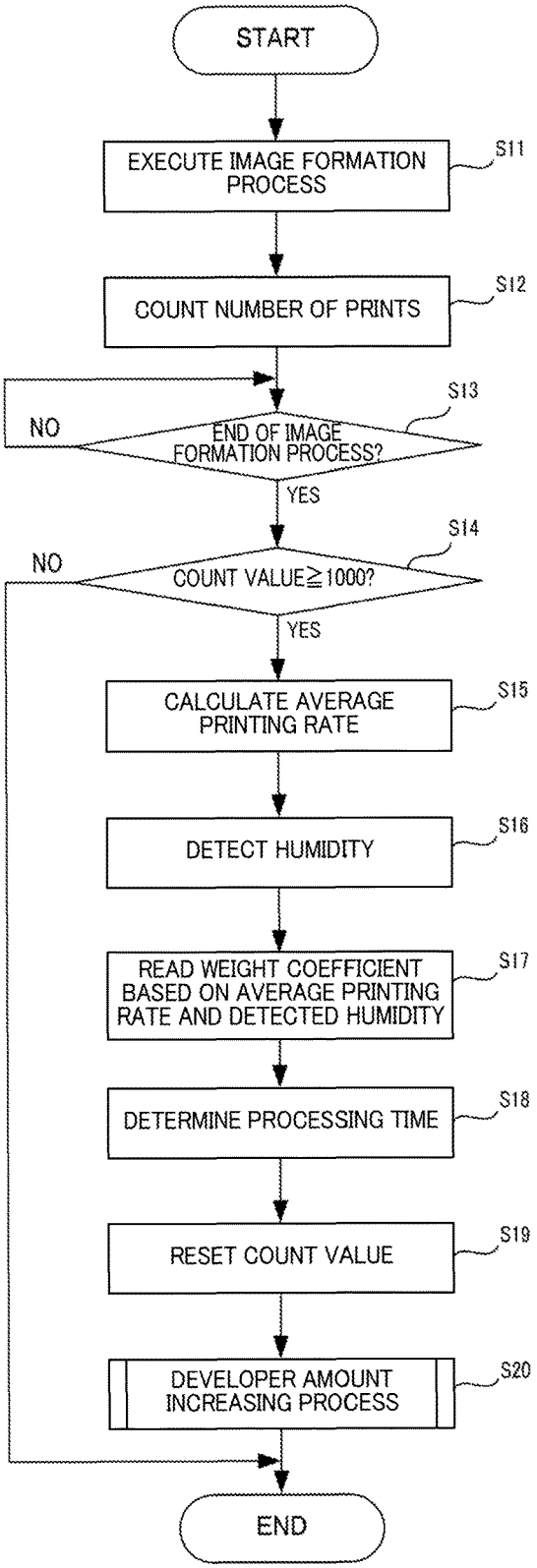
FIG. 6 is a flowchart showing an example of procedures of a cleaning process executed by the control portion according to the first embodiment of the present disclosure.
Figure 7:
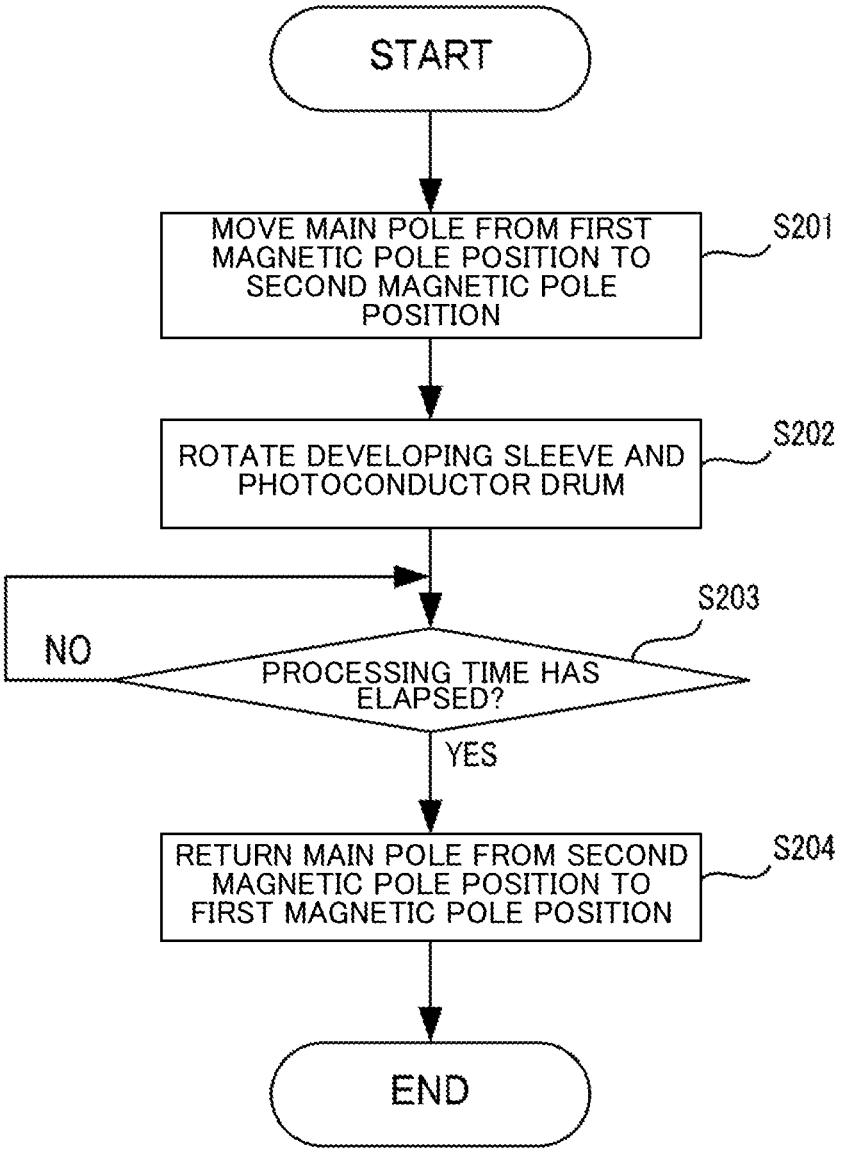
FIG. 7 is a flowchart showing an example of procedures of a developer amount increasing process executed in the cleaning process according to the first embodiment of the present disclosure.
Figure 8A:
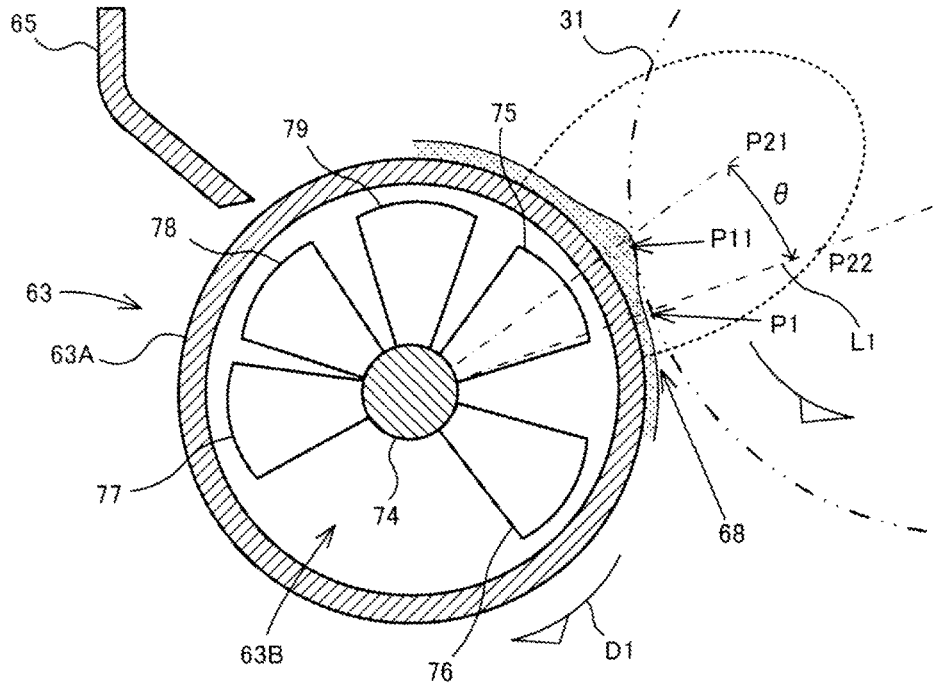
FIG. 8A and FIG. 8B show amounts of supplied developer that correspond to different positions of a main pole according to the first embodiment of the present disclosure.
Figure 8B:
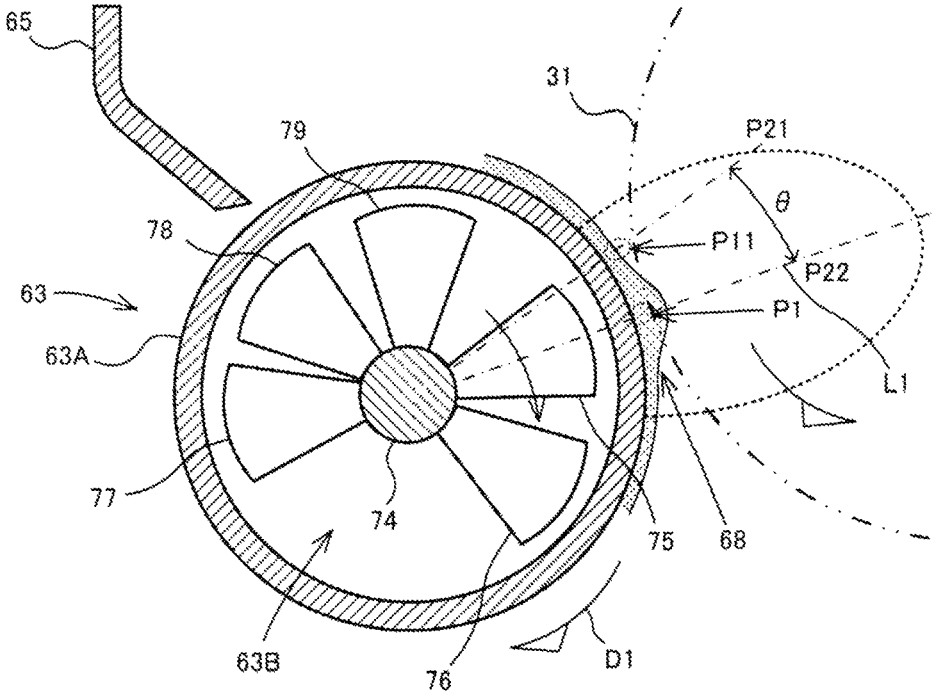

The following describes an example of the procedures of the cleaning process executed in the image forming apparatus 10 with reference to FIG. 8A and FIG. 8B by using the flowcharts shown in FIG. 6 and FIG. 7. Here, S11, S12, . . . in FIG. 6 and FIG. 7 represent numbers assigned to the processing procedures (steps).

Upon input of an image forming instruction to the image forming apparatus 10, the image forming portion 18 starts executing the image formation process (S11). During the execution of the image formation process, the control portion 90 counts the number of prints in the image formation process, and stores the count value in the RAM 93 or the EEPROM 94 (S12). Subsequently, upon determining that the image formation process has ended, the control portion 90 proceeds to step S14.

In step S14, the control portion 90 determines whether or not a cumulative value of the count value of the number of prints counted in step S12 has reached a predetermined set number of sheets (for example, 1000 sheets). It is noted that the set number of sheets is stored in the EEPROM 94 in advance, and the control portion 90 executes the determination process of step S14 by comparing the count value with the set number of sheets.

When it is determined in step S14 that the count value has not reached the set number of sheets (NO side at S14), the developer amount increasing process that is described below is not executed, and a series of processes end. On the other hand, when it is determined in step S14 that the count value has reached the set number of sheets (YES side at S14), the control portion 90 proceeds to step S15.

In step S15, an average printing rate (an example of the cumulative printing rate of the present disclosure) before the set number of sheets is counted is calculated. Here, a printing rate of a print sheet can be obtained from a dot count value of image data included in a print job that is input when the image formation process is executed. The control portion 90 stores the printing rate in the EEPROM 94 in a cumulative manner for each print sheet on which the image formation process is executed, and when it is determined in step S14 that the count value has reached the set number of sheets, calculates the average printing rate from the cumulative information of the printing rate and the set number of sheets.

Subsequently, in step S16, the control portion 90 detects the absolute humidity in the external environment of the housing 14 based on the electric signal from the humidity sensor 40.

Subsequently, the control portion 90 reads, from the EEPROM 94, a weight coefficient that is used for determining a processing time for executing the developer amount increasing process that is described below, based on the average printing rate calculated in step S15 and the humidity detected in step S16 (S17). Here, the processing time is correlated with the average printing rate and the humidity. The EEPROM 94 stores, in advance, a table (see Table 1) that shows weight coefficients corresponding to the average printing rate and the humidity. In the present embodiment, as shown in Table 1, the state level that indicates the level of the absolute humidity outside the housing 14 is classified into levels 1 to 5, and weight coefficient for different ranges of the average printing rate are assigned to each of the humidity levels.

TABLE 1

| Absolute humidity in external environment: A (0.1 g/m$^3$) | | Average printing rate: B (%) | | | | |
|---|---|---|---|---|---|---|
| State level | Range of absolute humidity | 0 ≤ B < 0.5 | 0.5 ≤ B < 1.0 | 1.0 ≤ B < 2.0 | 2.0 ≤ B < 6.0 | 6.0 ≤ B |
| Level 1 | 0 ≤ A < 44 | 3 | 3 | 2 | 1 | 0 |
| Level 2 | 44 ≤ A < 45 | 3 | 3 | 2 | 0 | 0 |
| Level 3 | 45 ≤ A < 175 | 2 | 2 | 1 | 0 | 0 |
| Level 4 | 175 ≤ A < 255 | 1 | 0 | 0 | 0 | 0 |
| Level 5 | 255 ≤ A | 0 | 0 | 0 | 0 | 0 |

Here, the state levels are defined as follows. The level 1 represents the environment state of a so-called cold region (low-temperature low-humidity state), and the range of the absolute humidity A is defined to be equal to or higher than 0 and lower than 44. The level 2 represents an intermediate environment state between the low-temperature low-humidity state and an average state that is described below, and the range of the absolute humidity A is defined to be equal to or higher than 44 and lower than 45. The level 3 represents an average humidity state (average state) in a normal temperature range (5° C. to 35° C.) regulated by JIS (Japanese Industrial Standards), and the range of the absolute humidity A is defined to be equal to or higher than 45 and lower than 175. The level 4 represents an intermediate environment state between the average state and a high-temperature high-humidity state that is described below, and the range of the absolute humidity A is defined to be equal to or higher than 175 and lower than 255. The level 5 represents the environment state of a so-called high-temperature high-humidity region (high-temperature high-humidity state), and the range of the absolute humidity A is defined to be equal to or higher than 255.

In addition, the average printing rate B is classified into five ranges: equal to or higher than 0% and lower than 0.5%; equal to or higher than 0.5% and lower than 1.0%; equal to or higher than 1.0% and lower than 2.0%; equal to or higher than 2.0% and lower than 6.0%; and equal to or higher than 6.0%. As shown in Table 1, the lower the state level is, the higher the weight coefficient is, and the lower the average printing rate is, the higher the weight coefficient is. This is because the contact load of the cleaning blade 36A increases as the residual toner decreases due to continuous developing at a low printing rate, and discharge products such as nitrogen oxides (NOx) are apt to be generated during charging such as the corona discharge by the charging device 32 as the environment state approaches the low-temperature low-humidity environment.

Subsequently, in step S18, a time which is obtained by multiplying the weight coefficient read from Table 1 by a predetermined set time (for example, 60 seconds), is determined as the processing time of the developer amount increasing process that is described below. The determined processing time is stored into the EEPROM 94. Subsequently, the control portion 90 resets the count value (S19), and executes the developer amount increasing process (S20). It is noted that as shown in Table 1, weight coefficient "0" is defined for the ranges in which the average printing rate and the state level are high. As a result, when the weight coefficient is "0", the processing time obtained in step S18 by performing the multiplication is "0". In this case, the cleaning performance of the deposits that have adhered to the outer circumferential surface of the photoconductor drum 31 is excellent even without execution of the developer amount increasing process. As a result, after the count value is reset, a series of processes end without executing the developer amount increasing process.

The following describes an example of the procedures of the developer amount increasing process with reference to the flowchart shown in FIG. 7. The developer amount increasing process is executed in the cleaning process so as to supply a more amount of developer to the developing gap 68 than an amount of developer supplied during the image formation process. Specifically, the control portion 90 moves the main pole 75 of the developing roller 63 from the first magnetic pole position P21 to the second magnetic pole position P22 (S201). Subsequently, the control portion 90 rotationally drives the developing sleeve 63A and the photoconductor drum 31 (S202). At this time, the charging device 32 does not perform the charging on the photoconductor drum 31. Subsequently, in step S203, the control portion 90 determines whether or not the processing time determined in the step S18 has elapsed. That is, the developing sleeve 63A and the photoconductor drum 31 are rotationally driven for the processing time. Upon the lapse of the processing time, in step S204, the control portion 90 returns the main pole 75 of the developing roller 63 from the second magnetic pole position P22 to the first magnetic pole position P21.

The image forming apparatus 10 of the first embodiment configured as described above executes the cleaning process and the developer amount increasing process as described above. This makes it possible to generate a magnetic field at the facing position P1 in the developing gap 68 during non image formation (see FIG. 8B), wherein the generated magnetic field is stronger than a magnetic field for developing that is generated by the main pole 75 during image formation (see FIG. 8A). As a result, a more amount of developer is supplied to the developing gap 68 during non image formation (see FIG. 8B) than an amount of developer for developing supplied to the developing gap 68 during image formation (see FIG. 8A). When the developer is supplied in this way, the magnetic brush formed at the facing position P1 in the developing gap 68 comes into contact with the outer circumferential surface of the photoconductor drum 31. As a result, even if the cleaning blade 36A of the cleaning device 36 is deteriorated, the magnetic brush that comes into contact with the photoconductor drum 31 effectively removes the deposits such as residual toner, external additives, and discharge products that have adhered to the outer circumferential surface of the photoconductor drum 31.

Second Embodiment

Figure 9:
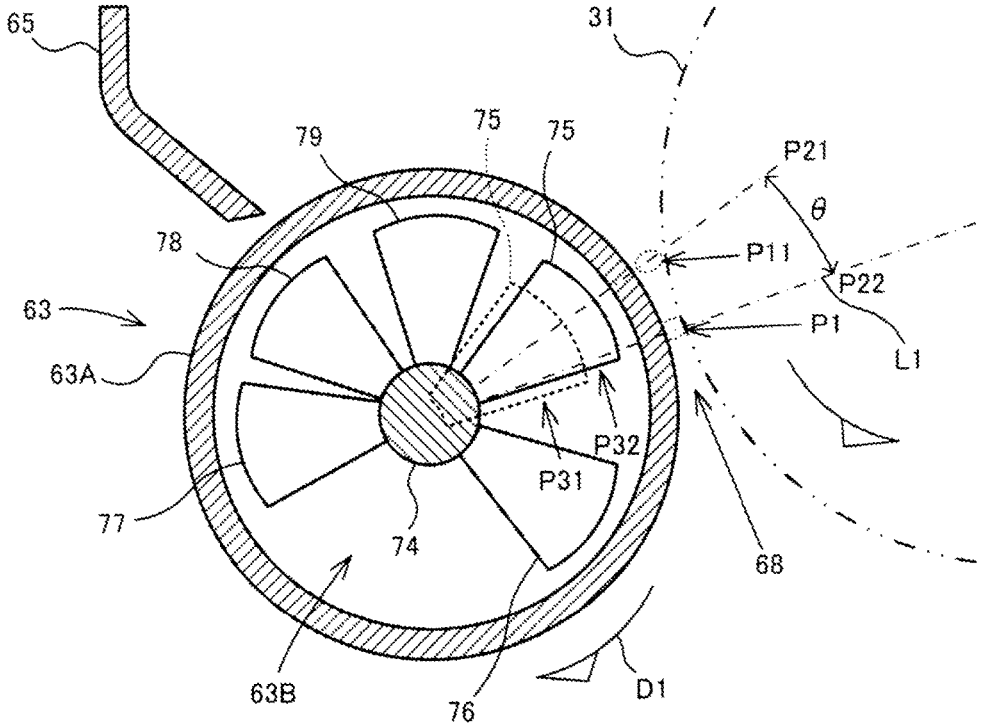
FIG. 9 shows movement states of a main pole according to a second embodiment of the present disclosure.

Next, a second embodiment of the present disclosure is described. In the first embodiment, a configuration where the main pole 75 is moved between the first magnetic pole position P21 and the second magnetic pole position P22 is described as one example. In the present embodiment, as shown in FIG. 9, the main pole 75 is configured to be moved (displaced) in a direction (hereinafter, referred to as a contact and separation direction) in which to contact and separate from the outer circumferential surface of the photoconductor drum 31. It is noted that since the other configuration of the second embodiment is common to the configuration of the first embodiment, description of the common configuration is omitted in the present embodiment.

In the present configuration, during image formation, the main pole 75 is disposed at a third magnetic pole position P31 that is more on the inner side of the developing sleeve 63A than the outer circumferential surface of the photoconductor drum 31 by a predetermined distance. In addition, in the developer amount increasing process performed in the step S20, the control portion 90 executes, in place of step S201 (see FIG. 7), a process of moving the main pole 75 from the third magnetic pole position P31 to a fourth magnetic pole position P32 that is closer to the outer circumferential surface of the photoconductor drum 31 than the third magnetic pole position P31, during non image formation. Furthermore, in place of step S204, the control portion 90 executes a process of returning the main pole 75 of the developing roller 63 from the fourth magnetic pole position P32 to the third magnetic pole position P31. The control portion 90 that performs these processes is another example of the magnetic pole position control portion of the present disclosure.

The image forming apparatus 10 of the second embodiment configured as described above also executes the developer amount increasing process. This makes it possible to generate a magnetic field that is stronger than the magnetic field for developing at the facing position P1 in the developing gap 68 during non image formation when the main pole 75 is moved to the fourth magnetic pole position P32. As a result, a more amount of developer is supplied to the developing gap 68 during non image formation than an amount of developer for developing supplied to the developing gap 68 during image formation. As a result, the magnetic brush that comes into contact with the photoconductor drum 31 effectively removes the deposits that have adhered to the outer circumferential surface of the photoconductor drum 31.

Third Embodiment

Figure 10:
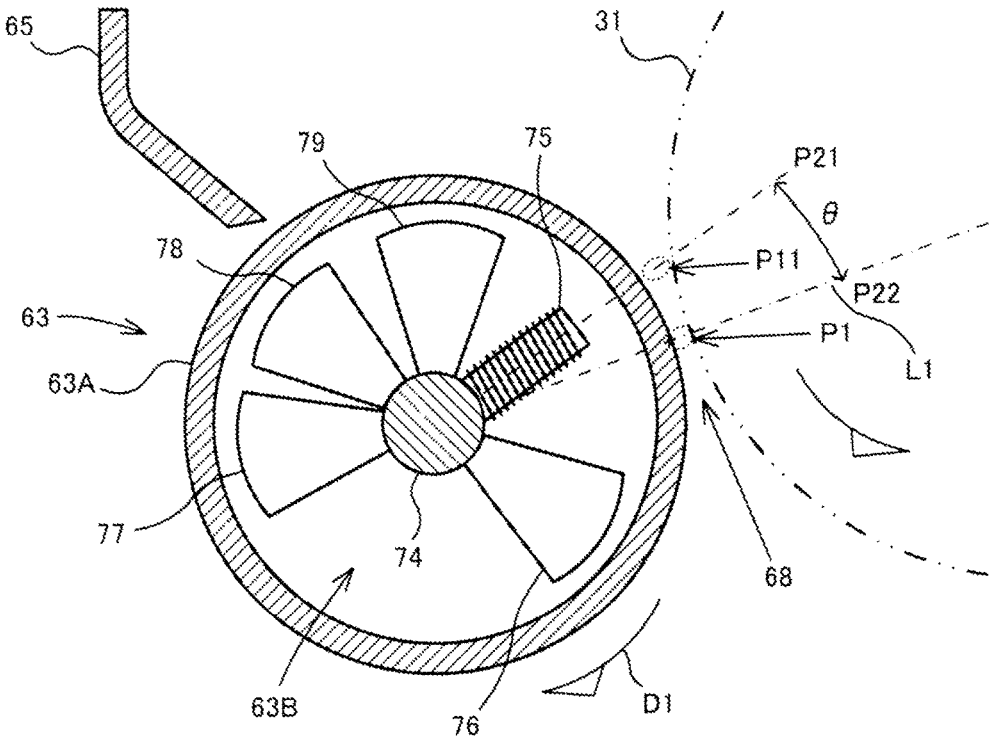
FIG. 10 shows a configuration of a main pole according to a third embodiment of the present disclosure.

Next, a third embodiment of the present disclosure is described. In the first and second embodiments, a configuration where the main pole 75 can be moved is described as one example. In the present embodiment, as shown in FIG. 10, the main pole 75 is not constituted from a permanent magnet, but is constituted from an electromagnet that generates a magnetic force corresponding to a value of supplied current. It is noted that since the other configuration of the third embodiment is common to the configuration of the first embodiment, description of the common configuration is omitted in the present embodiment.

In the present configuration, the main pole 75 is fixed to the support shaft 74 of the magnet unit 63B. In this case, the control portion 90 supplies an exciting current to the coil of the main pole 75, and changes the strength of the magnetic field generated by the main pole 75 by adjusting the exciting current. In the present embodiment, during image formation, the control portion 90 conducts a developing current that is required for the developing, through the coil of the main pole 75. In addition, in the developer amount increasing process performed in the step S20, the control portion 90 executes, in place of step S201, a process of conducting a current that is larger than the developing current, through the coil of the main pole 75 during non image formation. Furthermore, the control portion 90 executes, in place of step S204, a process of returning the current flowing through the coil of the main pole 75 of the developing roller 63, to the developing current. The control portion 90 performing this process is an example of the electromagnet current conduction control portion of the present disclosure.

The image forming apparatus 10 of the third embodiment configured as described above also executes the developer amount increasing process as described above. This makes it possible to generate a magnetic field that is stronger than the magnetic field for developing at the facing position P1 in the developing gap 68 during non image formation when a current larger than the developing current is conducted through the main pole 75. As a result, a more amount of developer is supplied to the developing gap 68 during non image formation than an amount of developer for developing supplied to the developing gap 68 during image formation. As a result, the magnetic brush that comes into contact with the photoconductor drum 31 effectively removes the deposits that have adhered to the outer circumferential surface of the photoconductor drum 31.

Fourth Embodiment

Next, a fourth embodiment of the present disclosure is described. The present embodiment is different from the first embodiment in that: the main pole 75 is fixed to the first magnetic pole position P21; the regulation pole 78 is supported by the magnet unit 63B so as to be able to pivot between a fifth magnetic pole position P41 and a sixth magnetic pole position P42 that are described below; and the control portion 90 causes the regulation pole 78 to be displaced to the fifth magnetic pole position P41 or to the sixth magnetic pole position P42. In the following description, among the configurations of the present embodiment, configurations common to those of the first embodiment are assigned the same reference signs, and description thereof is omitted.

Figure 11:
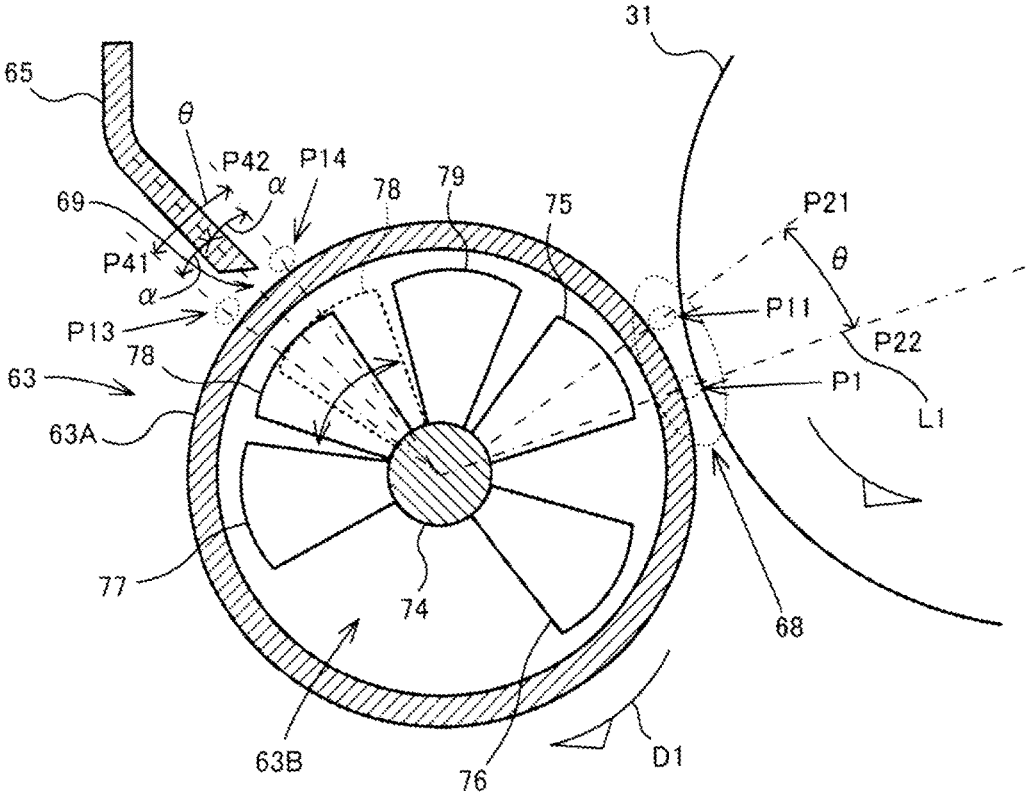
FIG. 11 is an enlargement diagram of a developing roller included in a developing device according to a fourth embodiment of the present disclosure.

As shown in FIG. 11, the main pole 75 is supported by the magnet unit 63B so as to be disposed at the first magnetic pole position P21. On the other hand, the regulation pole 78 is configured to be pivoted (displaced) around an axis of the magnet unit 63B. The regulation pole 78 is supported by a movable bracket (not shown). The movable bracket is pivotably supported by a support shaft 74 located at the center of the magnet unit 63B. With this configuration, the regulation pole 78 can pivot around the axis of the support shaft 74 of the magnet unit 63B. In the present embodiment, in the inside of the developing sleeve 63A, the regulation pole 78 is supported by the magnet unit 63B so as to be able to pivot between the fifth magnetic pole position P41 and the sixth magnetic pole position P42.

At both of the fifth magnetic pole position P41 and the sixth magnetic pole position P42, the regulation pole 78 can generate a magnetic field in the vicinity of the regulation gap 69 between the regulation blade 65 and the outer circumferential surface of the developing sleeve 63A. In FIG. 11, the regulation pole 78 represented by a solid line is located at the fifth magnetic pole position P41. When the regulation pole 78 is located at the fifth magnetic pole position P41, a peak magnetic force is applied to a third position P13 (an example of the third position of the present disclosure), and a magnetic field is generated at the third position P13. The third position P13 is located on the upstream side of the regulation gap 69 in the rotation direction D1 of the developing sleeve 63A, and separate from the regulation gap 69 by angle $\alpha$. In FIG. 11, the regulation pole 78 represented by a dotted line is located at the sixth magnetic pole position P42. When the regulation pole 78 is located at the sixth magnetic pole position P42, a peak magnetic force is applied to a fourth position P14 (an example of the fourth position of the present disclosure), and a magnetic field is generated at the fourth position P14. The fourth position P14 is located on the downstream side of the regulation gap 69 in the rotation direction D1 of the developing sleeve 63A, and separate from the regulation gap 69 by angle $\alpha$. In the present embodiment, the separation between the fifth magnetic pole position P41 and the sixth magnetic pole position P42 is represented by the angle $\theta$ ($=2\alpha$) that is the same as the pivot angle of the main pole 75 in the first embodiment.

The third motor 39 (see FIG. 5) transmits a rotational driving force to the movable bracket of the regulation pole 78. The third motor 39 is a driving source such as a stepping motor that outputs the rotational driving force. In the present embodiment, the third motor 39 is coupled with the movable bracket of the regulation pole 78, not with the main pole 75, via a transmission mechanism such as a gear. With this configuration, the regulation pole 78 together with the movable bracket can be displaced between the fifth magnetic pole position P41 and the sixth magnetic pole position P42. In the present embodiment, when a developer amount increasing process (see FIG. 12) that is described below is executed in the cleaning process (see FIG. 6), the regulation pole 78 is disposed at either the fifth magnetic pole position P41 or the sixth magnetic pole position P42.

In the present embodiment, when the image formation process is executed, the regulation pole 78 is disposed at the fifth magnetic pole position P41. In addition, when the cleaning process is executed, the regulation pole 78 is moved from the fifth magnetic pole position P41 to the sixth magnetic pole position P42. Here, the fifth magnetic pole position P41 is located on the upstream side of the regulation gap 69 in the rotation direction D1, and the sixth magnetic pole position P42 is located on the downstream side of the regulation gap 69 in the rotation direction D1. Accordingly, the magnetic field generated at the fourth position P14 when the regulation pole 78 is disposed at the sixth magnetic pole position P42, is higher in strength than the magnetic field generated at the fourth position P14 when the regulation pole 78 is disposed at the fifth magnetic pole position P41. As a result, in the state where the regulation pole 78 is disposed at the sixth magnetic pole position P42, a more amount of developer is collected at the fourth position P14 than in a case where the regulation pole 78 is disposed at the fifth magnetic pole position P41, due to a difference in strength of the magnetic field.

The following describes an example of the procedures of the cleaning process executed by the control portion 90 in the present embodiment. In the present embodiment, too, the processes of steps S11 to S20 are executed in accordance with the flowchart shown in FIG. 6.

Figure 12:
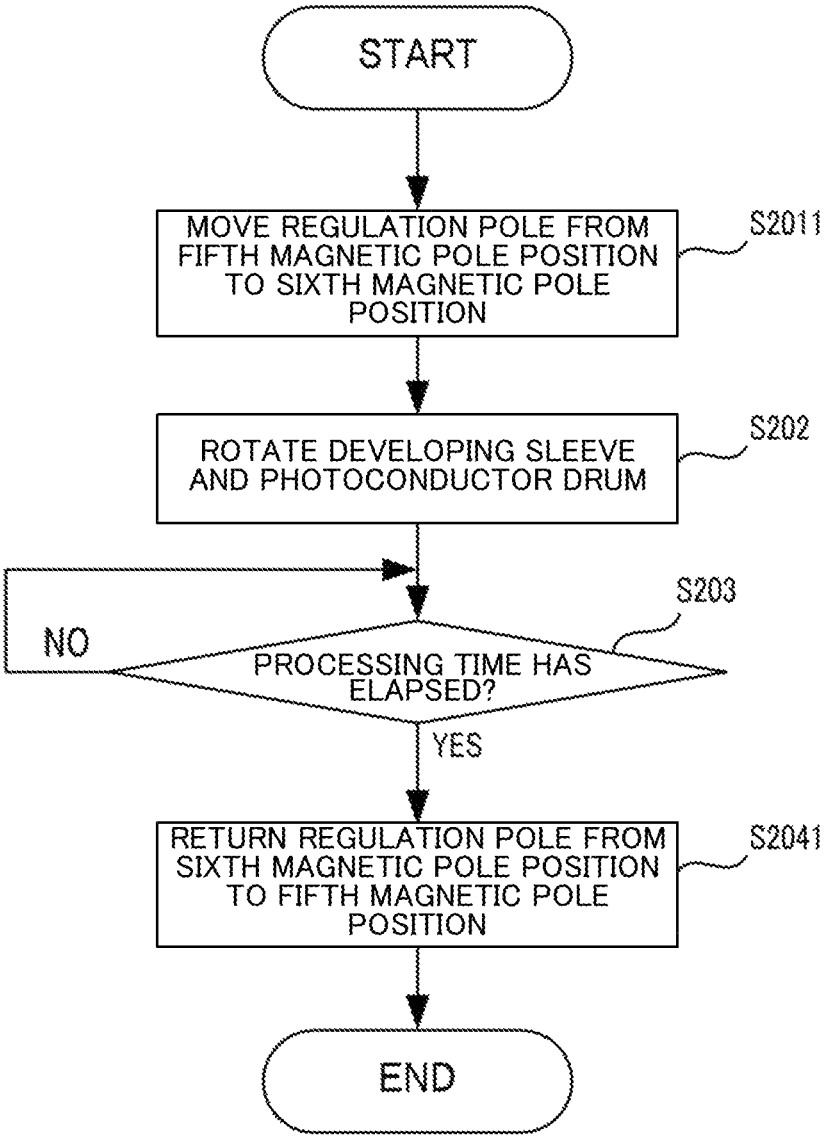
FIG. 12 is a flowchart showing another example of the procedures of the developer amount increasing process executed in a cleaning process according to the fourth embodiment of the present disclosure.

The following describes another example of the procedures of the developer amount increasing process performed in step S20, with reference to the flowchart shown in FIG. 12. It is noted that the control portion 90 that executes the following developer amount increasing process is an example of the regulation pole control portion of the present disclosure. The developer amount increasing process is executed in the cleaning process so as to supply a more amount of developer to the downstream side of the regulation gap 69 in the rotation direction D1 than an amount of developer supplied during the image formation process. Specifically, the control portion 90 moves the regulation pole 78 of the developing roller 63 from the fifth magnetic pole position P41 (see FIG. 11) to the sixth magnetic pole position P42 (see FIG. 11) (S2011). Subsequently, the control portion 90 rotationally drives the developing sleeve 63A and the photoconductor drum 31 (S202). At this time, the charging device 32 does not perform the charging on the photoconductor drum 31. Subsequently, in step S203, the control portion 90 determines whether or not the processing time determined in the step S18 in the flowchart of FIG. 6 has elapsed. That is, the developing sleeve 63A and the photoconductor drum 31 are rotationally driven for the processing time. Upon the lapse of the processing time, in step S2041, the control portion 90 returns the regulation pole 78 of the developing roller 63 from the sixth magnetic pole position P42 to the fifth magnetic pole position P41.

Figure 13A:
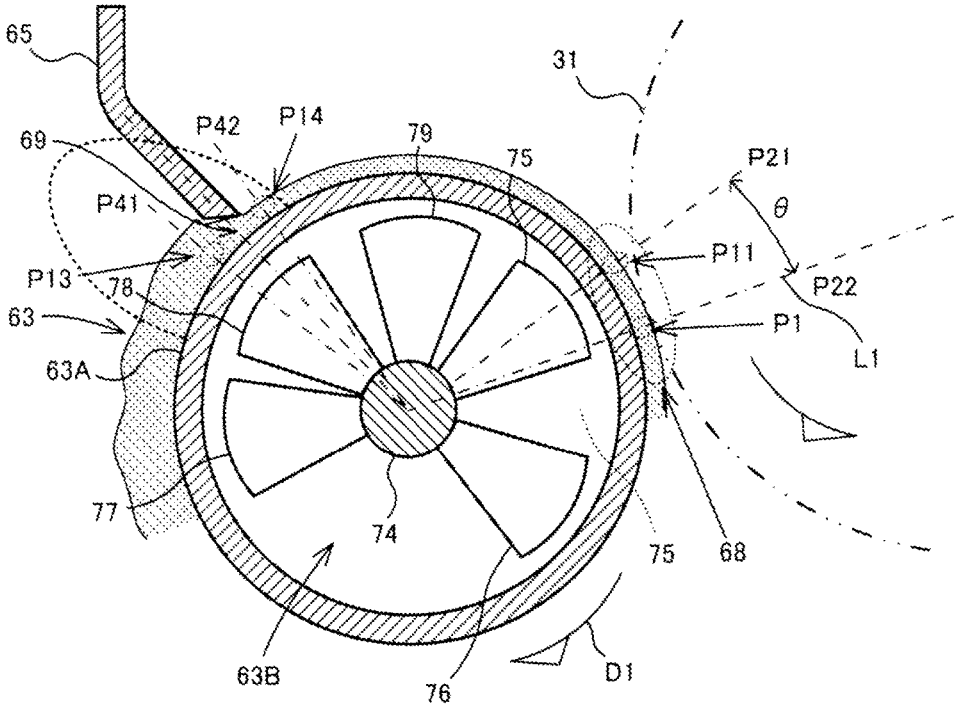
FIG. 13A and FIG. 13B show amounts of supplied developer that correspond to different positions of a regulation pole according to the fourth embodiment of the present disclosure.
Figure 13B:
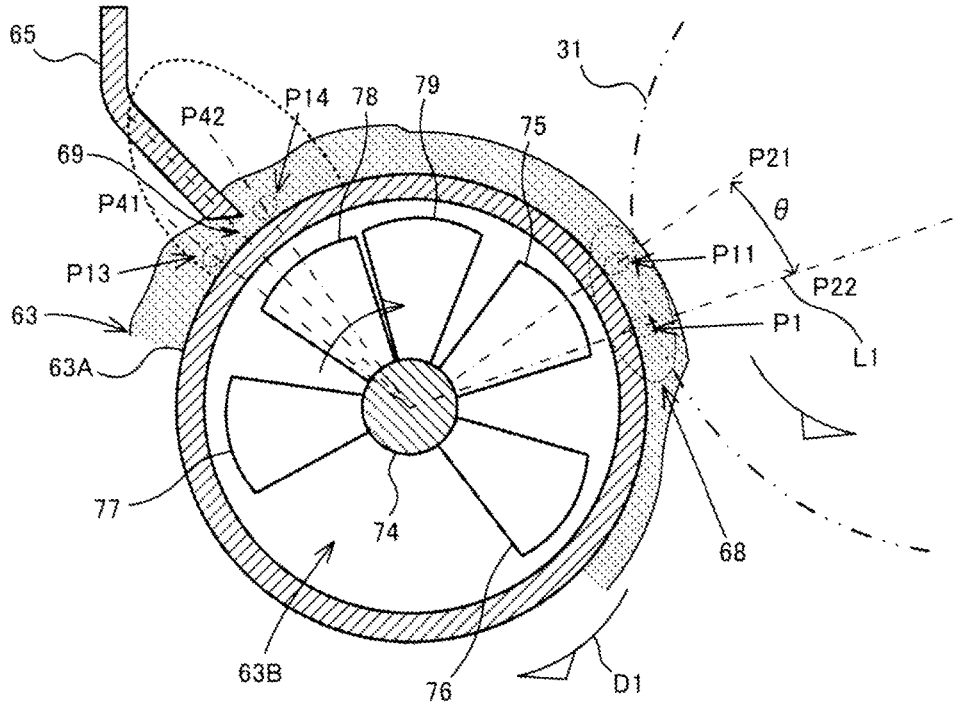

The image forming apparatus 10 of the fourth embodiment configured as described above executes the cleaning process and the developer amount increasing process as described above. This makes it possible to generate a magnetic field at the fourth position P14 during non image formation (see FIG. 13B), the magnetic field being stronger than a magnetic field for regulation that is generated by the regulation pole 78, at the fourth position P14 during image formation (see FIG. 13A). As a result, during image formation, the developer kept on the developing sleeve 63A is regulated by the regulation blade 65 so as to have a predetermined layer thickness. On the other hand, during non image formation, although the developer kept on the developing sleeve 63A is regulated by the regulation blade 65, a magnetic field stronger than the magnetic field for regulation is generated at the fourth position P14. Due to the influence of the stronger magnetic field, the developer is attracted from the upstream side to the downstream side of the regulation blade 65 via the regulation gap 69. As a result, a more amount of developer is supplied to the developing gap 68 during non image formation (see FIG. 13B) than an amount of developer for developing supplied to the developing gap 68 during image formation (see FIG. 13A). When the developer is supplied in this way, the magnetic brush formed at the facing position P1 in the developing gap 68 comes into contact with the outer circumferential surface of the photoconductor drum 31. As a result, even if the cleaning blade 36A of the cleaning device 36 is deteriorated, the magnetic brush that comes into contact with the photoconductor drum 31 effectively removes the deposits such as residual toner, external additives, and discharge products that have adhered to the outer circumferential surface of the photoconductor drum 31.

[Modification of Fourth Embodiment]

In the first embodiment, a configuration where the main pole 75 is pivoted by angle θ is described, and in the fourth embodiment, a configuration where the regulation pole 78 is pivoted by angle θ is described. However, the present disclosure is not limited to such configurations. For example, in a state where the main pole 75 and the regulation pole 78 are fixed to the magnet unit 63B, the magnet unit 63B itself may be rotated. In this case, the third motor 39 is coupled with a transmission mechanism such as a gear provided on a rotation shaft of the magnet unit 63B. In this configuration, during image formation, the control portion 90 rotationally controls the magnet unit 63B to move to a position such that the main pole 75 is disposed at the first magnetic pole position P21, and the regulation pole 78 is disposed at the fifth magnetic pole position P41. In addition, during non image formation, the control portion 90 rotationally controls the magnet unit 63B to move to a position such that the main pole 75 is disposed at the second magnetic pole position P22, and the regulation pole 78 is disposed at the sixth magnetic pole position P42.

Fifth Embodiment

Figure 14:
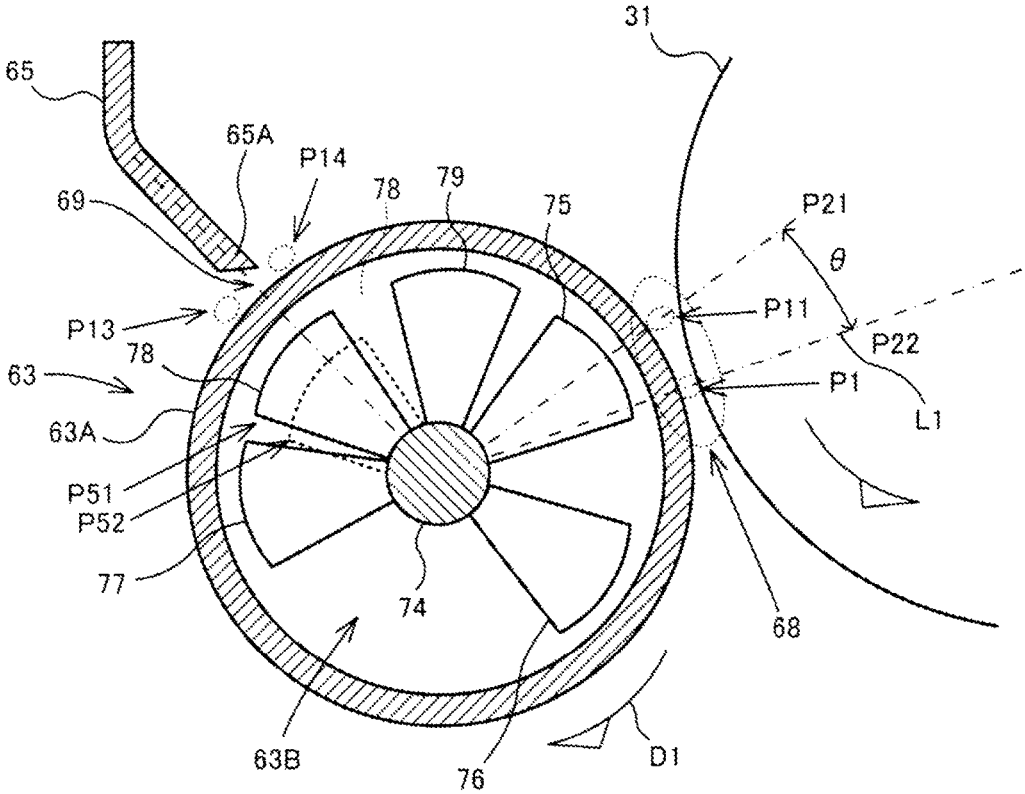
FIG. 14 shows movement states of a regulation pole according to a fifth embodiment of the present disclosure.

Next, a fifth embodiment of the present disclosure is described. In the fourth embodiment, a configuration where the regulation pole 78 is configured to be moved between the fifth magnetic pole position P41 and the sixth magnetic pole position P42, is described as one example. In the present embodiment, as shown in FIG. 14, the regulation pole 78 is configured to be moved (displaced) in a direction (hereinafter, referred to as a contact and separation direction) in which to contact and separate from the tip portion 65A of the regulation blade 65. It is noted that since the other configuration of the fifth embodiment is common to the configuration of the second embodiment, description of the common configuration is omitted in the present embodiment.

In the present configuration, during image formation, the regulation pole 78 is disposed at a seventh magnetic pole position P51 located close to the tip portion 65A of the regulation blade 65. That is, the regulation pole 78 is disposed at a position close to the regulation gap 69. In FIG. 14, the regulation pole 78 represented by a solid line is located at the seventh magnetic pole position P51. In addition, in the developer amount increasing process performed in the step S20, the control portion 90 executes, in place of step S2011 (see FIG. 12), a process of moving the regulation pole 78 from the seventh magnetic pole position P51 to an eighth magnetic pole position P52 that is farther separated from the tip portion 65A than the seventh magnetic pole position P51, during non image formation. In FIG. 14, the regulation pole 78 represented by a dotted line is located at the eighth magnetic pole position P52, separate from the regulation gap 69 toward the support shaft 74. In addition, in place of the step S2041, the control portion 90 executes a process of returning the regulation pole 78 of the developing roller 63 from the eighth magnetic pole position P52 to the seventh magnetic pole position P51. The control portion 90 performing this process is another example of the regulation magnetic pole control portion of the present disclosure.

The image forming apparatus 10 of the fifth embodiment configured as described above also executes the developer amount increasing process as described above. This makes it possible to generate a magnetic field that is weaker than the magnetic field for regulation, at the third position P13 during non image formation when the regulation pole 78 is moved from the seventh magnetic pole position P51 to the eighth magnetic pole position P52. As a result, less developer would stay at the third position P13 under the influence of the magnetic field, and when the developing sleeve 63A rotates, more developer is supplied to the regulation gap 69 side than during developing. With this configuration, although the developer is regulated by the regulation blade 65, a more amount of developer is supplied to the developing gap 68 during non image formation than the amount of developer for developing supplied to the developing gap 68 during image formation. As a result, the magnetic brush that comes into contact with the photoconductor drum 31 effectively removes the deposits that have adhered to the outer circumferential surface of the photoconductor drum 31.

Sixth Embodiment

Figure 15:
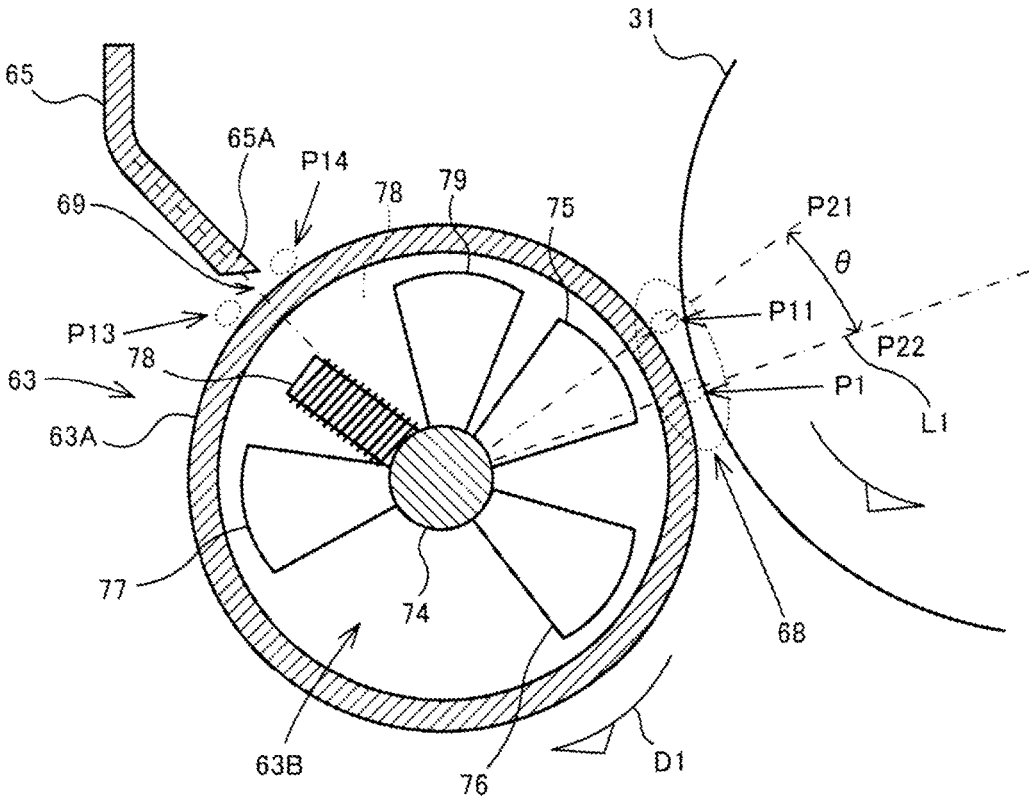
FIG. 15 shows a configuration of a regulation pole according to a sixth embodiment of the present disclosure.

Next, a sixth embodiment of the present disclosure is described. In the fourth and fifth embodiments, a configuration where the regulation pole 78 can be moved is described as one example. In the present embodiment, as shown in FIG. 15, the regulation pole 78 is not constituted from a permanent magnet, but is constituted from an electromagnet that generates a magnetic force corresponding to a value of supplied current. It is noted that since the other configuration of the sixth embodiment is common to the configuration of the fourth embodiment, description of the common configuration is omitted in the present embodiment.

In the present configuration, the regulation pole 78 is fixed to the support shaft 74 of the magnet unit 63B. In this case, the control portion 90 supplies an exciting current to the coil of the regulation pole 78, and changes the strength of the magnetic field generated by the regulation pole 78 by adjusting the exciting current. In the present embodiment, during image formation, the control portion 90 conducts a regulation current through the regulation pole 78 so that an amount of developer required for the developing by the developing device 33 passes through the regulation gap 69. With such a conduction of current, an amount of developer required for the developing is supplied to the developing gap 68. In addition, in the developer amount increasing process performed in the step S20, the control portion 90 executes, in place of step S2011, a process of conducting a current that is smaller than the regulation current, through the coil of the regulation pole 78 during non image formation. Furthermore, the control portion 90 executes, in place of step S2041, a process of returning the current flowing through the coil of the regulation pole 78 of the developing roller 63, to the regulation current. The control portion 90 performing this process is another example of the electromagnet current conduction control portion of the present disclosure.

The image forming apparatus 10 of the sixth embodiment configured as described above also executes the developer amount increasing process as described above. This makes it possible to generate a magnetic field that is weaker than the magnetic field for regulation at the third position P13 during non image formation when a current smaller than the regulation current is conducted through the regulation pole 78. As a result, less developer would stay at the third position P13 under the influence of the magnetic field, and when the developing sleeve 63A rotates, more developer is supplied to the regulation gap 69 side than during developing. With this configuration, although the developer is regulated by the regulation blade 65, a more amount of developer is supplied to the developing gap 68 during non image formation than the amount of developer for developing supplied to the developing gap 68 during image formation. As a result, the magnetic brush that comes into contact with the photoconductor drum 31 effectively removes the deposits that have adhered to the outer circumferential surface of the photoconductor drum 31.

Seventh Embodiment

Next, a seventh embodiment of the present disclosure is described. The present embodiment is different from the fourth embodiment in that: the main pole 75 is fixed to the first magnetic pole position P21; the regulation pole 78 provided in the inside of the developing sleeve 63A is fixed to the fifth magnetic pole position P41; the regulation blade 65 is configured to be moved (displaced) in a direction D2 (see FIG. 16, hereinafter the direction is referred to as a contact and separation direction) in which to contact and separate from the roller surface of the developing sleeve 63A; and the control portion 90 displaces the regulation blade 65 in the contact and separation direction D2. In the following description, among the configurations of the present embodiment, configurations common to those of the fourth embodiment are assigned the same reference signs, and description thereof is omitted.

Figure 16:
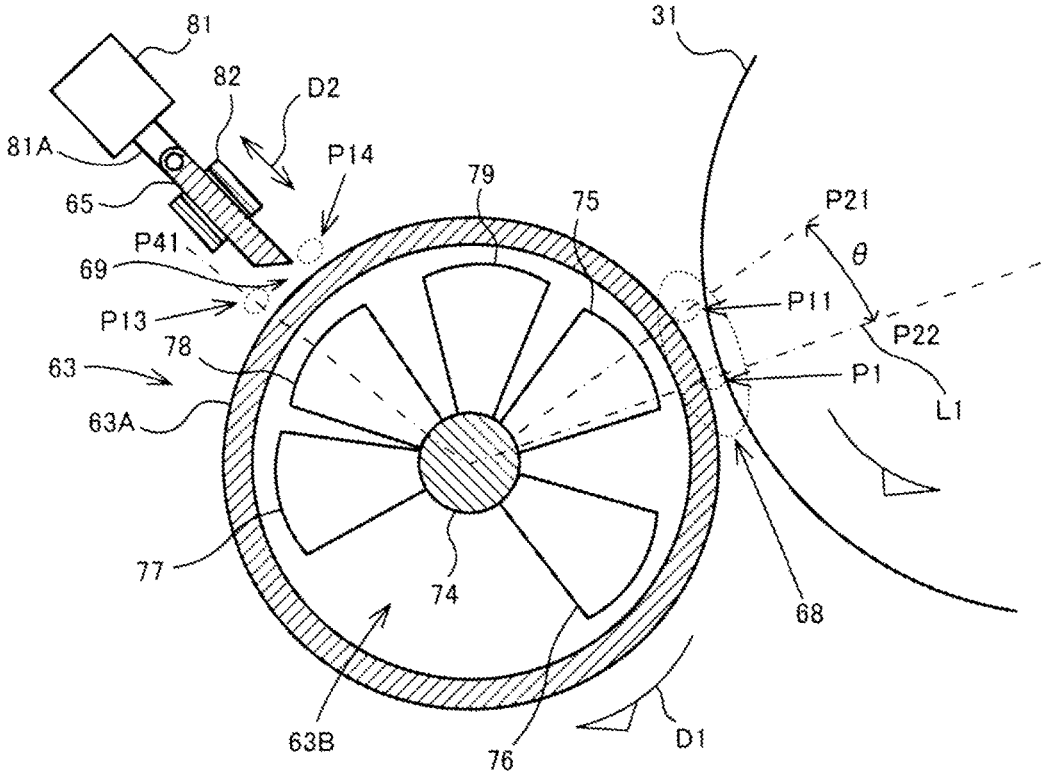
FIG. 16 is an enlargement diagram of a developing roller included in a developing device according to a seventh embodiment of the present disclosure.
Figure 19A:
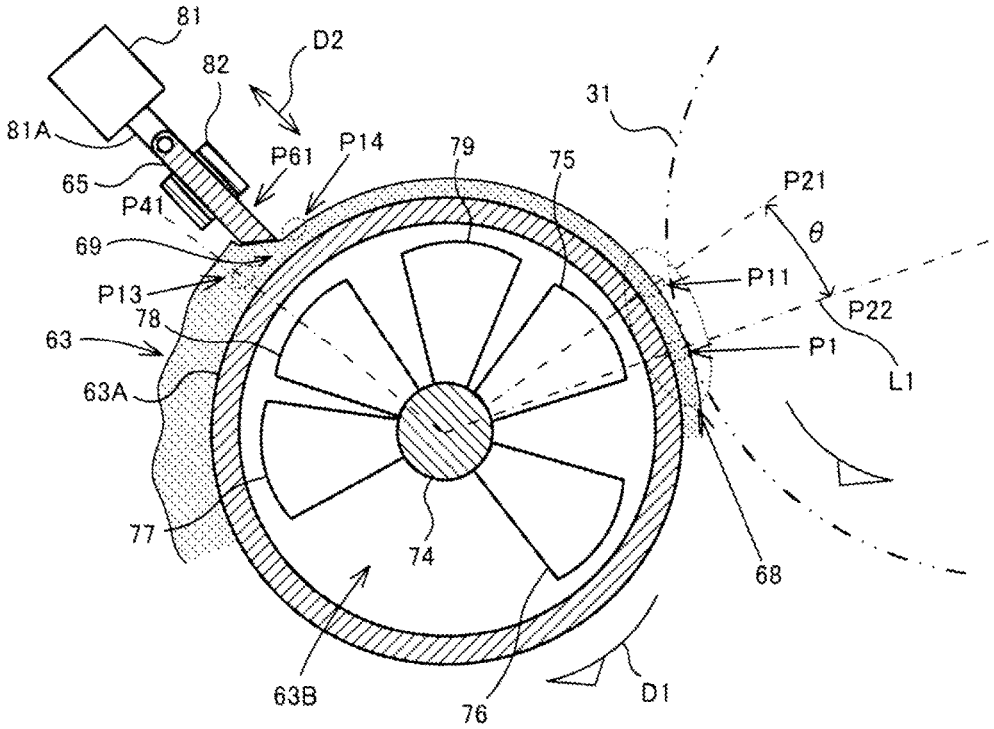
FIG. 19A and FIG. 19B show amounts of supplied developer that correspond to different positions of a regulation blade according to the seventh embodiment of the present disclosure.
Figure 19B:
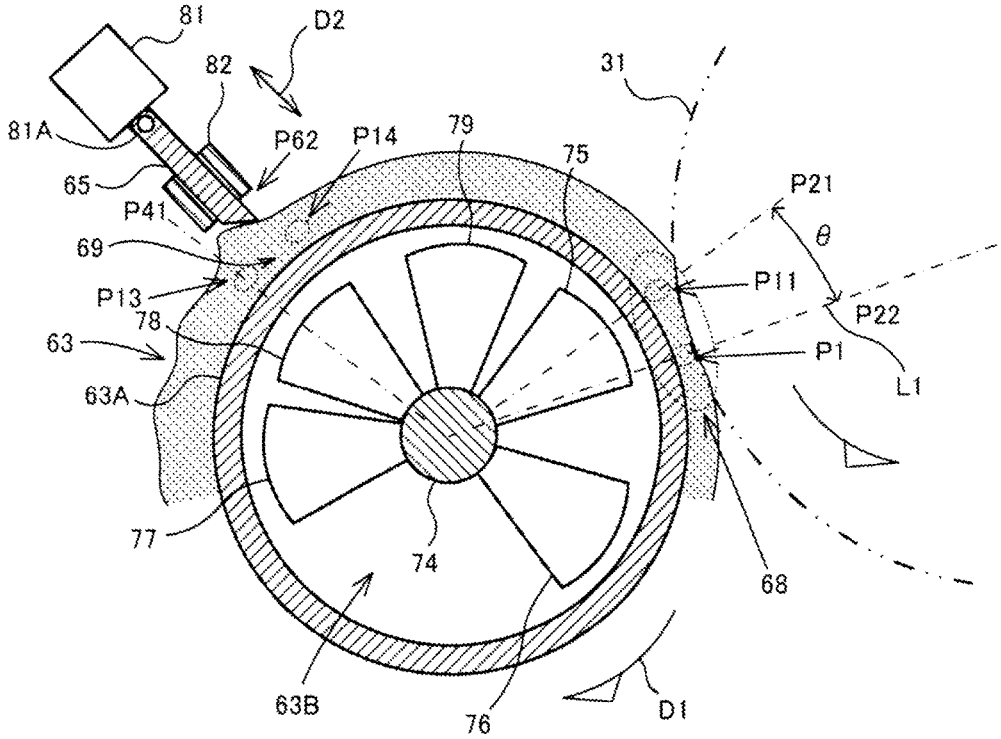

As shown in FIG. 16, the regulation blade 65 is supported by a support portion 82 so as to be movable in the contact and separation direction D2 in which to contact and separate from the roller surface of the developing sleeve 63A. The support portion 82 is integrally formed with the developer holder 60 of the developing device 33, and includes an insertion hole that supports the regulation blade 65 in a state where the regulation blade 65 is inserted therein. In addition, a solenoid 81 is provided in the inside of the developer holder 60 as a drive source that is driven upon conduction of current therethrough and moves a plunger 81A. The plunger 81A is coupled with the regulation blade 65. As a result, when the solenoid 81 is driven, the regulation blade 65 is displaced in the contact and separation direction D2. In the present embodiment, in a current non-conduction state, the solenoid 81 causes a coil spring that is provided in its inside, to bias the plunger 81A to a protruding position, and in a current conduction state, the solenoid 81 causes the plunger 81A to move against the biasing force of the coil spring from the protruding position to a retracted position retracted in the inside of the solenoid 81. Accordingly, the regulation blade 65 is displaced in the contact and separation direction D2 depending on the operation of the solenoid 81. Specifically, when the solenoid 81 is in the current non-conduction state, the regulation blade 65 is disposed at a proximate position P61 (a position shown in FIG. 19A) close to the developing sleeve 63A, and when the solenoid 81 is in the current conduction state, the regulation blade 65 is disposed at a separate position P62 (a position shown in FIG. 19B) that is more separate from the developing sleeve 63A than the proximate position P61.

The regulation blade 65 is disposed at the proximate position P61 during image formation. When the regulation blade 65 is disposed at the proximate position P61, an amount of developer required for the developing is conveyed toward the downstream of the regulation gap 69 in the rotation direction D1. On the other hand, the regulation blade 65 is disposed at the separate position P62 during non image formation. When the regulation blade 65 is disposed at the separate position P62, a more amount of developer than the amount of developer required for the developing is conveyed toward the downstream of the regulation gap 69 in the rotation direction D1. In the present embodiment, the separate position P62 is determined as one example such that the length of the regulation gap 69 between the regulation blade 65 and the outer circumferential surface of the developing roller 63 during non image formation is twice that during image formation.

Figure 17:
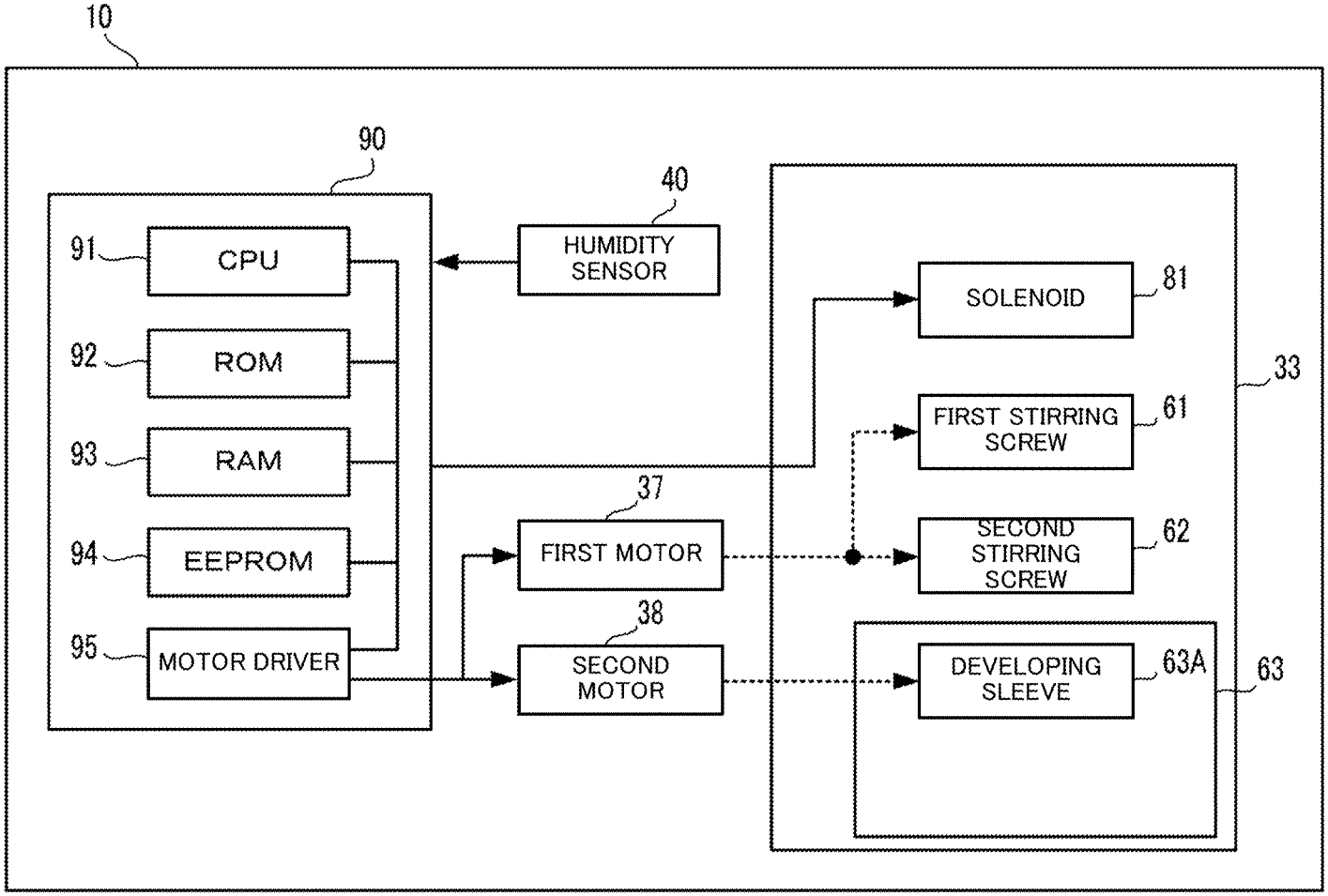
FIG. 17 is a block diagram showing a configuration of a control portion included in an image forming apparatus according to the seventh embodiment of the present disclosure.

As shown in FIG. 17, the control portion 90 is electrically connected with the solenoid 81 of the developing device 33, and drive-controls the solenoid 81 by supplying an exciting signal (exciting current) to the solenoid 81. It is noted that in the present embodiment, the third motor 39 is not provided.

In the present embodiment, when a developer amount increasing process that is described below, is executed in the cleaning process, the regulation blade 65 is disposed at either the proximate position P61 or the separate position P62.

The following describes an example of the procedures of the cleaning process executed by the control portion 90 in the present embodiment. In the present embodiment, too, the processes of steps S11 to S20 are executed in accordance with the flowchart shown in FIG. 6.

Figure 18:
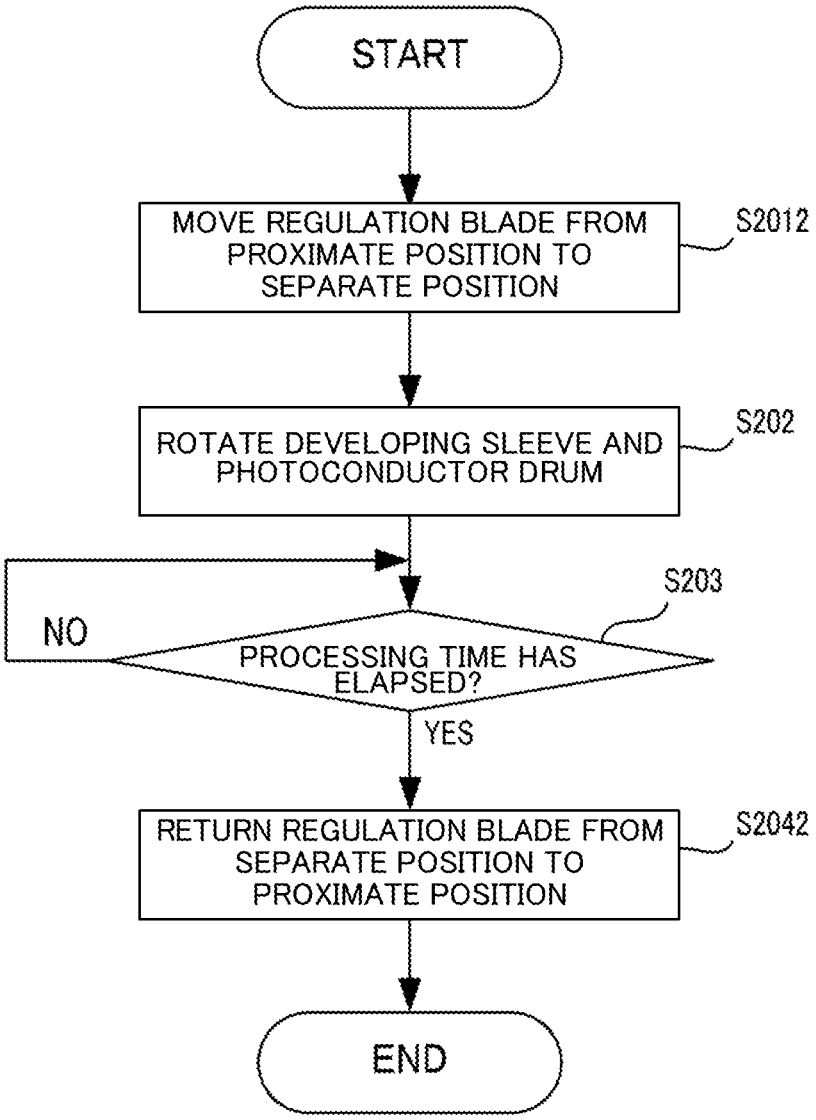
FIG. 18 is a flowchart showing another example of the procedures of the developer amount increasing process executed in a cleaning process according to the seventh embodiment of the present disclosure.

The following describes another example of the procedures of the developer amount increasing process performed in step S20, with reference to the flowchart shown in FIG. 18. It is noted that the control portion 90 that executes the following developer amount increasing process is an example of the blade position control portion of the present disclosure. The developer amount increasing process is executed in the cleaning process so as to supply a more amount of developer to the downstream side of the regulation gap 69 in the rotation direction D1 than an amount of developer supplied during the image formation process. Specifically, the control portion 90 drives the solenoid 81 by supplying an exciting current to the solenoid 81 so that the regulation blade 65 is displaced from the proximate position P61 to the separate position P62 (S2012). Subsequently, the control portion 90 rotationally drives the developing sleeve 63A and the photoconductor drum 31 (S202). At this time, the charging device 32 does not perform the charging on the photoconductor drum 31. Subsequently, in step S203, the control portion 90 determines whether or not the processing time determined in the step S18 in the flowchart of FIG. 6 has elapsed. That is, the developing sleeve 63A and the photoconductor drum 31 are rotationally driven for the processing time. Upon the lapse of the processing time, in step S2042, the control portion 90 returns the regulation blade 65 from the separate position P62 to the proximate position P61 by stopping supplying the exciting current to the solenoid 81.

The image forming apparatus 10 of the seventh embodiment configured as described above executes the cleaning process and the developer amount increasing process as described above. This makes it possible to displace, during non image formation, the regulation blade 65 that had been disposed at the proximate position P61 during image formation, in a direction of being separated from the outer circumferential surface of the developing sleeve 63A. With this configuration, the regulation gap 69 is expanded during non image formation. As a result, a more amount of developer is supplied to the developing gap 68 during non image formation (see FIG. 19B) than an amount of developer for developing supplied to the developing gap 68 during image formation (see FIG. 19A). When the developer is supplied in this way, the magnetic brush formed at the facing position P1 in the developing gap 68 comes into contact with the outer circumferential surface of the photoconductor drum 31. As a result, even if the cleaning blade 36A of the cleaning device 36 is deteriorated, the magnetic brush that comes into contact with the photoconductor drum 31 effectively removes the deposits such as residual toner, external additives, and discharge products that have adhered to the outer circumferential surface of the photoconductor drum 31.

It is noted that in the above-described embodiments, the processing time is explained as being correlated with both the average printing rate and the humidity. However, the processing time may be correlated with only the average printing rate, or only the humidity outside the image forming apparatus 10. In addition, in the above-described embodiments, a processing example in which the external humidity is used as the installation environment of the image forming apparatus 10 is described. However, a processing example in which the external temperature is used as the installation environment of the image forming apparatus 10 may be adopted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a developer storage portion storing developer that includes toner and carrier;

a developing roller provided in an inside of the developer storage portion and configured to be rotationally driven;

a magnetic force generating portion provided in an inside of the developing roller and configured to generate a magnetic force for keeping the developer on an outer circumferential surface of the developing roller; and an image carrying member disposed to face the developing roller across a predetermined developing gap, configured to be rotationally driven, receive the toner from the developer supplied to the developing gap by the developing roller, and keep a toner image on an outer circumferential surface of the image carrying member, wherein a more amount of developer is supplied to the developing gap during non image formation than an amount of developer for developing supplied to the developing gap during image formation such that the outer circumferential surface of the image carrying member is cleaned.

2. The image forming apparatus according to claim 1, wherein the magnetic force generating portion includes a developing magnetic pole that is configured to generate a magnetic field in the developing gap, and the developing magnetic pole generates, during the non image formation, a magnetic field that is higher in strength than a magnetic field for developing that is generated by the developing magnetic pole during the image formation so that a more amount of developer is supplied to the developing gap during the non image formation than the amount of the developer for developing.

3. The image forming apparatus according to claim 2, wherein the developing magnetic pole is configured to be displaced between a first magnetic pole position and a second magnetic pole position, wherein when the developing magnetic pole is disposed at the first magnetic pole position, a peak magnetic field is generated at a first position that is included in the developing gap and located on an upstream side of a facing position in a rotation direction of the developing roller, the facing position being a position in the developing gap at which the developing roller faces the image carrying member, and when the developing magnetic pole is disposed at the second magnetic pole position, a peak magnetic field is generated at a second position that is closer to the facing position than to the first position, and the image forming apparatus further comprises:

a magnetic pole position control portion configured to displace the developing magnetic pole to either the first magnetic pole position or the second magnetic pole position, displace the developing magnetic pole to the first magnetic pole position during the image formation, and displace the developing magnetic pole to the second magnetic pole position during the non image formation.

4. The image forming apparatus according to claim 2, wherein the developing magnetic pole is configured to be displaced in the developing roller in a contact and separation direction with respect to the image carrying member, and the image forming apparatus further comprises:

a magnetic pole position control portion configured to displace the developing magnetic pole in the contact and separation direction, displace the developing magnetic pole to a third magnetic pole position during the image formation, and displace the developing magnetic pole to a fourth magnetic pole position during the non image formation, the third magnetic pole position being separate from the image carrying member, the fourth magnetic pole position being closer to the image carrying member than the third magnetic pole position.

5. The image forming apparatus according to claim 3, wherein the magnetic pole position control portion, during the non image formation, displaces the developing magnetic pole for a time that corresponds to either or both of a cumulative printing rate in an image formation process and an installation environment of the image forming apparatus.

6. The image forming apparatus according to claim 2, wherein the developing magnetic pole is an electromagnet that generates a magnetic force corresponding to a value of supplied current, and the image forming apparatus further comprises:

an electromagnet current conduction control portion configured to change a current that is conducted through the developing magnetic pole, conduct a developing current that is required for developing, through the developing magnetic pole during the image formation, and conduct a current that is larger than the developing current, through the developing magnetic pole during the non image formation.

7. The image forming apparatus according to claim 6, wherein the electromagnet current conduction control portion, during the non image formation, conducts the current that is larger than the developing current, through the developing magnetic pole for a time that corresponds to either or both of a cumulative printing rate in an image formation process and an installation environment of the image forming apparatus.

8. The image forming apparatus according to claim 1, further comprising:

a blade member provided on an upstream side of the developing gap in a rotation direction of the developing roller so as to form a regulation gap between itself and the developing roller, thereby regulating an amount of developer that is conveyed to a downstream side in the rotation direction of the developing roller, wherein the magnetic force generating portion includes:

a regulation magnetic pole disposed to face the blade member and configured to generate a magnetic field for regulation in a peripheral of the regulation gap, and the image forming apparatus further comprises:

a regulation magnetic pole control portion configured to change a strength of the magnetic field for regulation during the non image formation so as to supply a more amount of developer to the developing gap during the non image formation than an amount of developer for developing supplied to the developing gap during the image formation.

9. The image forming apparatus according to claim 8, wherein the regulation magnetic pole is configured to be displaced between a fifth magnetic pole position and a sixth magnetic pole position, wherein when the regulation magnetic pole is disposed at the fifth magnetic pole position, a peak magnetic field is generated at a third position that is located on an upstream side of the regulation gap in the rotation direction of the developing roller, and when the regulation magnetic pole is disposed at the sixth magnetic pole position, a peak magnetic field is generated at a fourth position that is located on a downstream side of the regulation gap in the rotation direction, and the regulation magnetic pole control portion displaces the regulation magnetic pole to either the fifth magnetic pole position or the sixth magnetic pole position, displaces the regulation magnetic pole to the fifth magnetic pole position during the image formation, and displaces the regulation magnetic pole to the sixth magnetic pole position during the non image formation.

10. The image forming apparatus according to claim 8, wherein the regulation magnetic pole is configured to be displaced in the developing roller in a contact and separation direction with respect to the blade member, and the regulation magnetic pole control portion displaces the regulation magnetic pole in the contact and separation direction, displaces the regulation magnetic pole to a seventh magnetic pole position during the image formation, and displaces the regulation magnetic pole to an eighth magnetic pole position during the non image formation, the seventh magnetic pole position being close to the blade member, the eighth magnetic pole position being farther separated from the blade member than the seventh magnetic pole position.

11. The image forming apparatus according to claim 8, wherein the regulation magnetic pole is an electromagnet that generates a magnetic force corresponding to a value of supplied current, and the regulation magnetic pole control portion is configured to change a current that is conducted through the regulation magnetic pole, conducts a regulation current through the regulation magnetic pole so that an amount of developer required for developing passes through the regulation gap during the image formation, and conducts a current that is smaller than the regulation current, through the regulation magnetic pole during the non image formation.

12. The image forming apparatus according to claim 8, wherein the regulation magnetic pole control portion, during the non image formation, changes the strength of the magnetic field for regulation for a time that corresponds to either or both of a cumulative printing rate in an image formation process and an installation environment of the image forming apparatus so as to supply a more amount of developer to the developing gap during the non image formation than the amount of the developer for developing.

13. The image forming apparatus according to claim 1, further comprising:

a blade member provided on an upstream side of the developing gap in a rotation direction of the developing roller so as to form a regulation gap between itself and the developing roller, thereby regulating an amount of developer that is conveyed to a downstream side in the rotation direction of the developing roller, wherein the blade member is configured to be displaced in a contact and separation direction with respect to the outer circumferential surface of the developing roller, the magnetic force generating portion includes:

a regulation magnetic pole disposed to face the blade member and configured to generate a magnetic field for regulation in a peripheral of the regulation gap, and the image forming apparatus further comprises:

a blade position control portion configured to, during the non image formation, expand the regulation gap by displacing the blade member in a direction of being separated from the outer circumferential surface of the developing roller so as to supply a more amount of developer to the developing gap during the non image formation than the amount of the developer for developing.

14. The image forming apparatus according to claim 13, wherein the blade position control portion, during the non image formation, expands the regulation gap by displacing the blade member in the direction of being separated from the outer circumferential surface of the developing roller for a time that corresponds to either or both of a cumulative printing rate in an image formation process and an installation environment of the image forming apparatus.

* * * * *